US007278343B2

(12) United States Patent
Vanden Heuvel

(10) Patent No.: US 7,278,343 B2
(45) Date of Patent: Oct. 9, 2007

(54) APPARATUS FOR LAP SEAMING FLOOR COVERINGS

(76) Inventor: Rick J. Vanden Heuvel, W830 Cooper Rd., Oneida, WI (US) 54155

( * ) Notice: Subject to any disclaimer, the term of this patent is extended or adjusted under 35 U.S.C. 154(b) by 0 days.

(21) Appl. No.: 11/348,144

(22) Filed: Feb. 6, 2006

(65) Prior Publication Data

US 2006/0191386 A1 Aug. 31, 2006

Related U.S. Application Data

(63) Continuation of application No. 10/154,781, filed on May 24, 2002, now abandoned.

(51) Int. Cl.
*B26D 7/10* (2006.01)

(52) U.S. Cl. ..... 83/171; 83/745; 83/591

(58) Field of Classification Search ..... 83/16, 83/170, 171, 491, 591, 597, 743, 745; 156/584, 156/344; 30/300, 310; D23/317; D34/26
See application file for complete search history.

(56) References Cited

U.S. PATENT DOCUMENTS

| | | | | | |
|---|---|---|---|---|---|
| 1,253,705 | A | | 1/1918 | Metzger | |
| 1,598,070 | A | | 8/1926 | Faase | |
| 2,269,510 | A | * | 1/1942 | Bates | 30/310 |
| 2,275,733 | A | | 3/1942 | Clark | 30/276 |
| 2,487,327 | A | | 11/1949 | Ganter, Jr. | 30/167 |
| 2,557,699 | A | | 6/1951 | Silver | 33/41 |
| 2,619,173 | A | | 11/1952 | Crain | 164/57 |
| 2,622,680 | A | | 12/1952 | Yakubik | 164/17 |
| 2,686,248 | A | | 8/1954 | Green | 30/140 |
| 2,753,592 | A | | 7/1956 | Cochran | 18/1 |
| 2,765,531 | A | | 10/1956 | Campbell, Jr. | 30/140 |
| 3,148,448 | A | | 9/1964 | Gragg | 30/276 |
| 4,050,336 | A | | 9/1977 | Stubbings | 30/300 |
| 4,621,427 | A | | 11/1986 | Bergler | 30/310 |
| 4,827,625 | A | | 5/1989 | Le Moal | 33/527 |
| 4,939,968 | A | | 7/1990 | Stoof | 83/886 |
| 4,981,548 | A | * | 1/1991 | Poll | 156/584 |
| 5,040,445 | A | | 8/1991 | Liou | 83/886 |
| D333,346 | S | * | 2/1993 | Uhde | D23/317 |
| 5,188,013 | A | | 2/1993 | Cardinale | 83/879 |
| 5,205,045 | A | | 4/1993 | Liu | 33/468 |
| 5,438,757 | A | | 8/1995 | Weschenfelder | 30/139 |
| 5,526,573 | A | | 6/1996 | Peters | 30/310 |
| 5,617,642 | A | | 4/1997 | Marios | 33/526 |
| 5,626,124 | A | | 5/1997 | Chen | 125/23.02 |

(Continued)

*Primary Examiner*—Timothy V. Eley
*Assistant Examiner*—Jason Prone
(74) *Attorney, Agent, or Firm*—Andrus, Sceales, Starke & Sawall, LLP

(57) ABSTRACT

The present invention pertains to an apparatus for continuously cutting different floor coverings to form a uniform seam between them. The apparatus is particularly suited for vinyl and linoleum tile floor coverings. The apparatus is secured to a floor at a reference point or along a reference path. The different floor coverings are each placed on one of the separate areas so that they each overlap and continuously cover a border mark. Cutting and heating devices are secured to the apparatus substantially the same distance from the reference point or path. A drive mechanism propels the apparatus at a desired rate of speed to move the cutting device along the specific path of travel over the border to continuously heat and cut the overlapping floor coverings to form a uniform lap seam between them.

10 Claims, 27 Drawing Sheets

U.S. PATENT DOCUMENTS 5,709,767 A * 1/1998 Petino ..... 156/344
5,720,844 A * 2/1998 Hanson ..... 156/344
5,922,157 A 7/1999 Snider ..... 156/71
5,946,808 A 9/1999 Martinez ..... 30/290
6,101,730 A 8/2000 Marino ..... 33/526
6,455,812 B1 * 9/2002 Houle ..... 156/344
6,755,481 B2 6/2004 Katsumoto ..... 30/310

* cited by examiner

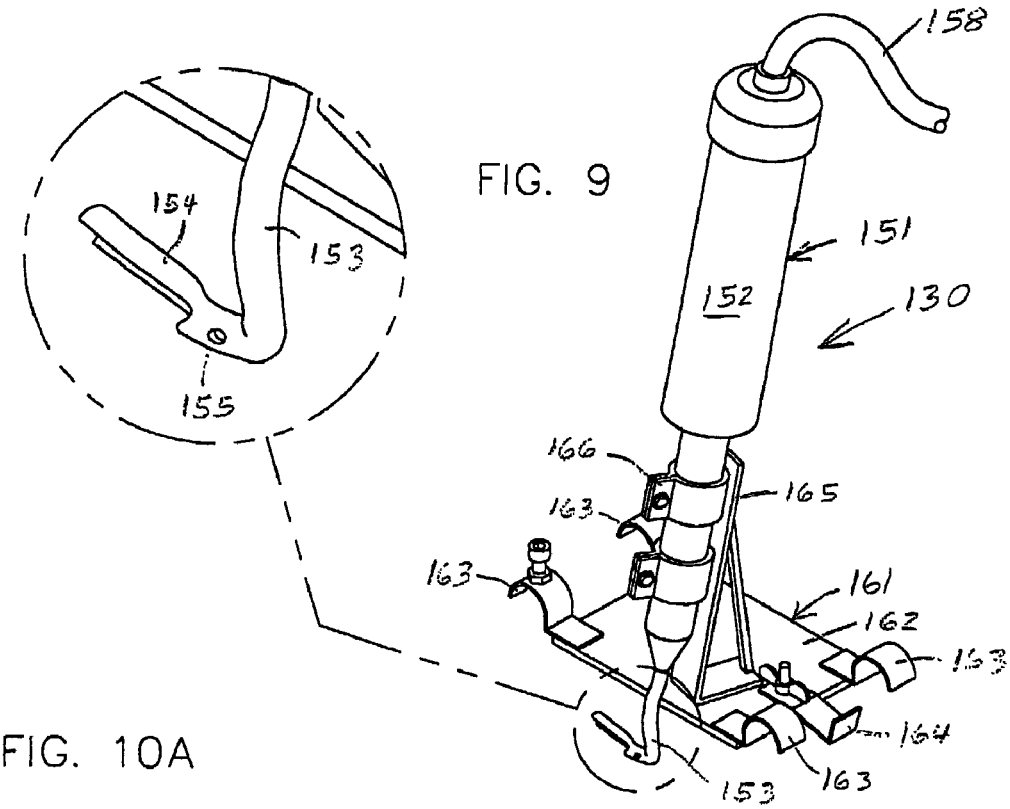
FIG. 9
FIG. 10A
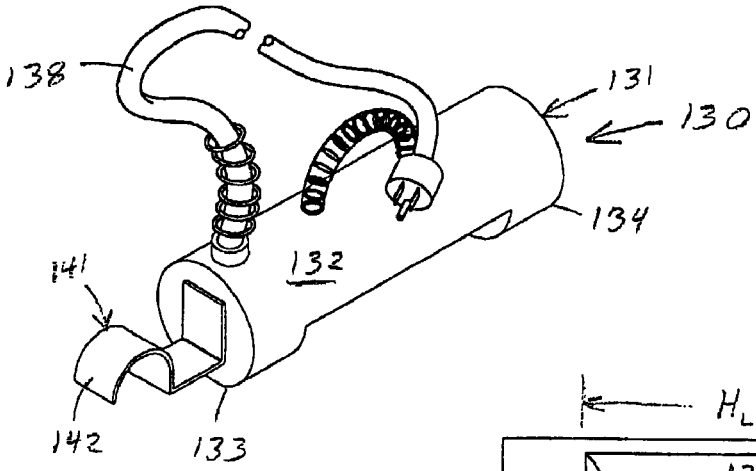
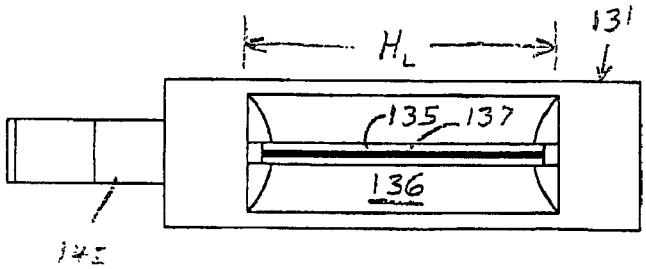
FIG. 10B

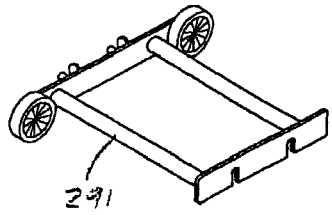
FIG. 12A
FIG. 12B
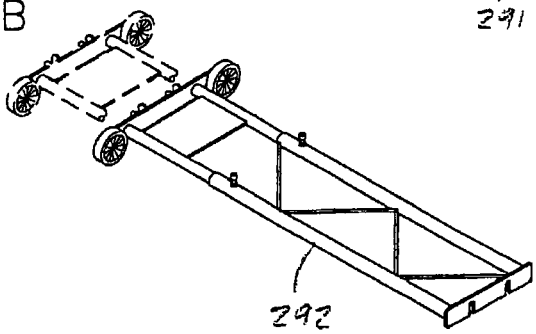
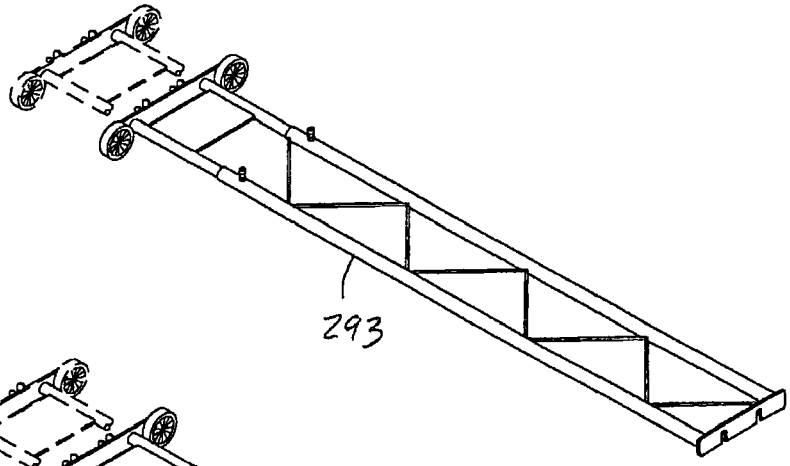
FIG. 12C
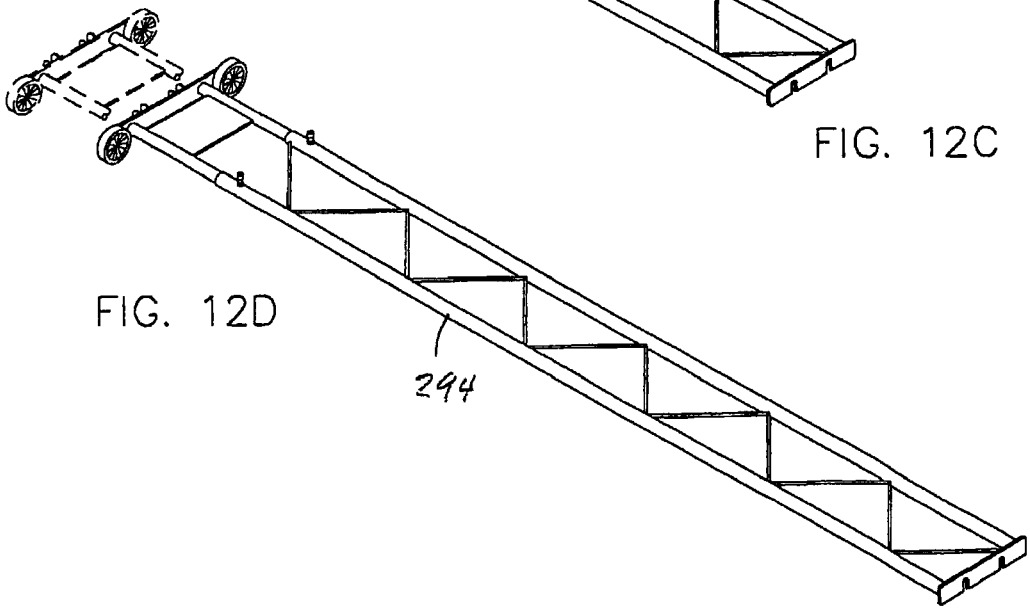
FIG. 12D

FIG. 13A
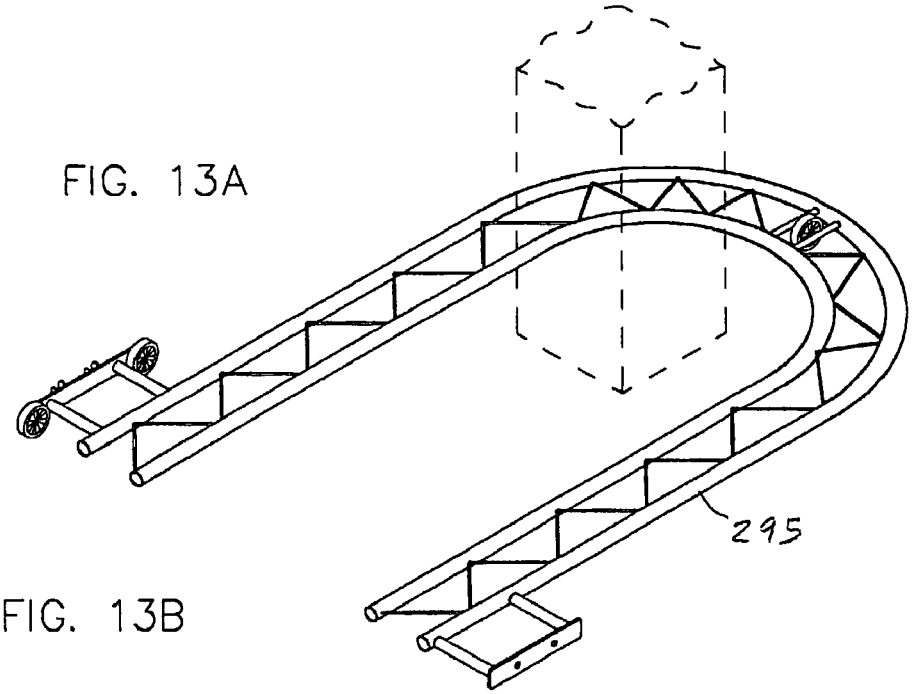
FIG. 13B
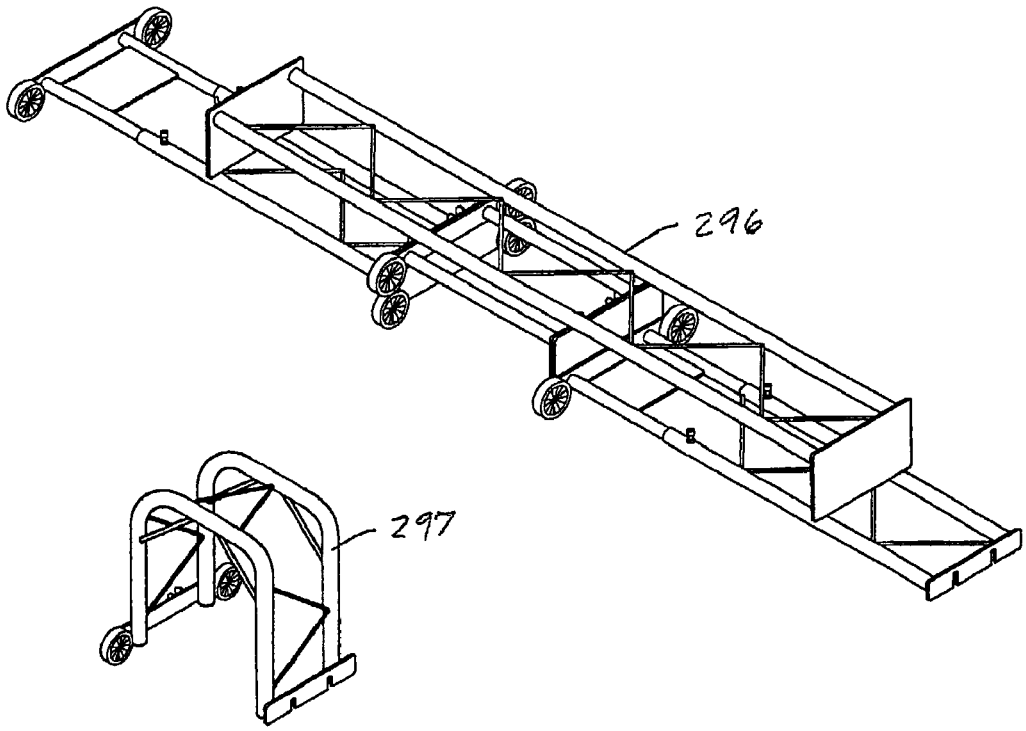
FIG. 13C

APPARATUS FOR LAP SEAMING FLOOR COVERINGS

CROSS REFERENCE TO RELATED APPLICATION

This application is a Continuation of U.S. patent application Ser. No. 10/154,781, filed May 24, 2002 now abandoned.

TECHNICAL FIELD OF THE INVENTION

The present invention relates to an apparatus and method for marking a floor by securing the apparatus at a reference point or path so as to move along a desired path of travel to form a border mark, laying floor covering in an overlapping manner over the border mark, and moving the apparatus along the path of travel to continuously cut the floor coverings along the border mark to form a uniform seam between them.

BACKGROUND OF THE INVENTION

Floor coverings are widely used as durable and attractive products to cover a floor of a building or one of its individual rooms. The floors are generally flat and made of structurally strong materials such as concrete, plywood, steel and the like. The floors require an attractive floor covering that is more appropriate for the intended living or working activities of the room. The relatively low cost and easy installation of floor covering such as vinyl and linoleum tile has created a demand for a wide variety of these products. The tile products fit together in a side-by-side arrangement or array that allows them to cover almost any floor surface or configuration. Individual batches of tiles are made with a specific surface color and texture. A batch of tile can have a single solid color or shade, or a blend of two or more colors. Similarly, the batch of tiles can have a surface texture that is smooth with a glossy or matted appearance or roughened with a course or grainy appearance. Different floor coverings made from different types of materials can have properties such as different densities, coefficients of friction or traction, and wear or chemical resistances.

Different floor coverings often abut along a straight seam that is covered by a transition plate, such as at a doorway between two rooms. Still, it is often desirable to cover the floor of a single room or area with two or more different types or styles of floor coverings for aesthetic or functional reasons. Different colored floor covering can improve the appearance of the room by creating an attractive design or pattern. Different types of floor coverings can provide different functional characteristics for different areas of the room such as along a walkway, entrance way, around a table, sink, appliance or piece of equipment, or the like.

One conventional method of laying different types or styles of floor coverings in a room 5 is to mark the upper surface 11 of its floor 10 to divide the surface into separate areas 12 and 14. For example, a pencil can be tied to one end of a string, and the other end of the string anchored to the floor 10 as in FIG. 1A. The pencil is extended until the string is taut and moved along a circular or semi-circular path to form a circular or semi-circular mark 15 that divides the room into separate areas. Glue or adhesive 17 is applied over the floor 10 except along a narrow area 18 on one side of the mark 15. The different floor coverings 20 and 30 are then set in place as in FIG. 1B. The floor coverings 20 and 30 have upper surfaces 22 and 32, respectively. The floor coverings

20 and 30 are in the form of individual tiles 24 and 34 arranged in a side-by-side manner or array 35. Each floor covering 20 and 30 is placed in one of the areas 12 or 14. Both floor coverings 20 and 30 continuously extend over the mark 15. The second floor covering 30 overlaps the first 20 along the mark 15. Given that the lower floor covering 20 completely covers the mark 15 on the floor 10, an additional mark (not shown) can be drawn on the surface 22 of the lower covering to ensure that the upper covering 30 completely extends over the mark 15. The edges of each tile 34 in the upper covering 30 are flushly aligned with the edges of the tile 24 in the lower covering 30 on which it is placed.

The overlapping floor coverings 20 and 30 are now cut to remove the excess trim 37 so that they both lay flat on the floor 10. As the first mark 15 is hidden by the floor coverings 20 and 30, the pencil and string are again used to make a second or third mark 38 on the surface 32 of the upper covering 30 as in FIG. 1C. The overlapping floor coverings 20 and 30 are now ready to be cut to form a seam 40 between them as in FIG. 1D. A template 42 is often made with an edge shaped to fit the curvature of the mark. The template 42 is placed on the upper tiles 30 and aligned so that its edge is flush with a section of the mark. Many small cuts are needed to form the entire seam 40. A propane torch 43 is frequently used to heat the section of the overlapping tiles 20 and 30 before each cut. Heated vinyl or linoleum tiles 24 and 34 are easier to cut. Once one section is heated, the torch 43 is put down and a hand held cutting tool 44 is used to cut the heated section of tiles 20 and 30. These steps are repeated one section at a time until each of the intermittent cuts is made and the entire seam 40 is formed. The intermittent formation of the seam 40 creates a number of discontinuities 45 where the template 42 or individual cuts were not properly aligned with the mark 38 or an adjacent cut as in FIG. 1E. As a result, a gap 46 between the edges of the adjacent floor coverings is inconsistent. Unintended scorch marks 47 and score marks 48 and are also frequently made on the surface 22 or 32 of the floor coverings 20 and 30. To hide these imperfections, the discontinuous seam 40 is often covered by a transition plate as in FIG. 1F.

A variety of tools have been developed to cut floor coverings such as vinyl and linoleum tiles and other similar dense semi-rigid products. Some of these tools are used to score, cut or lap seam two adjacent tiles or pieces of floor covering material together. Some examples of these conventional tools are shown and described in U.S. Pat. No. 5,188,013 to Cardinale, U.S. Pat. No. 3,148,448 to Gragg, U.S. Pat. No. 2,622,680 to Yakubik, U.S. Pat. No. 2,557,699 to Silver and U.S. Pat. No. 1,598,070 to Faase, the disclosures of which are incorporated by reference herein.

Many conventional tools for cutting floor coverings such as vinyl and linoleum tiles are intended to cut or trim the tiles one at a time before they are placed on the floor in their desired side-by-side arrangement. While these tools are readily used to cut like-shaped tiles to the same shape or dimensions, the tools are not readily used to make arcuate cuts in the tiles, particularly after they are secured to or positioned on the floor. Cutting individual pieces of floor covering tiles and then aligning them on the floor tends to create a non-uniform seam between the tiles. The pieces do not flushly align with their adjacent pieces when placed in the desired arrangement.

Conventional tools are not typically intended to make long continuous and uniform seams between two adjacent floor coverings, particularly when the floor covering is positioned over and secured to the floor in an array forming the intended design. Long seams are formed by smaller cuts.

Each cut is formed by a separate stroke or pass of the tool along a small section of the floor covering. Care is required to ensure that each cut is properly aligned with the previous cut and cut line for the seam, particularly when the cut line and seam have an arcuate shape. Each stroke of the tool must be aligned to start where the prior cut left off and made along the appropriate radius or arc. Even with proper care, the arcuate seam can have discontinuities between the individual cuts and the gap between the cut edges of the floor coverings. These anomalies produce a shoddy and unprofessional appearance that can require large sections of the floor coverings to be removed, replaced and recut to achieve an acceptable seam.

Conventional floor covering techniques and tools are time consuming to use and require a significant amount of manual labor. The density and durability of floor covering such as vinyl and linoleum tiles make them difficult to cut, particularly in an arcuate manner. Scoring and breaking tile along a score line is difficult or impossible to do once the tile is placed over and secured to the floor. Conventional hand tools for cutting the tile can require two or more strokes along the same cut line to cut completely through the tile. Each cut takes time and can result in an unsightly score mark on the surface of the tile if the tool ventures off the intended cut line.

When a template 42 is used, the edge of the template must flushly align the cut line. Any misalignment of the template along the cut line produces a discontinuity in the seam. The worker must guide the tool by hand along the edge of the template during each stroke of the tool. The blade should pass close to the edge of the template but should not cut into or become hung up on the template. If the tool is not properly guided, the blade can jump off line and gouge the floor coverings, damage the template, or injure the worker. Any imperfection in the shape of the template is transferred to the shape of the seam. Each use of the template duplicates the imperfection. Care is required to make each template and protect them from damage at the construction site and during storage.

When a portable, hand held propane torch 43 is used, the flame is directed at or near an area of the floor covering where the cut is to be made. The template protects the upper covering 30 while the trim portion 37 is exposed to the flame. Still, the upper floor covering will be exposed to the flame if the template is not flush aligned with the cut line. In addition, the lower floor covering is not protected by the template and will be exposed to the flame if it is not covered by the upper covering. Care is required each time the torch is used to keep from scorching the floor coverings or burning the worker. During the long and repetitive process of intermittently heating and cutting small sections of floor covering, workers are often hurt and the floor covering is often inadvertently scorched or otherwise discolored. The end result is a more costly project and an unprofessional looking seam.

Conventional hand tools and heating techniques provide the worker with little or no ability to set and gauge the depth of each cut. The worker may press the tool down harder or move it at a faster rate from one stroke to another. Different portions of cut may be heated to different temperatures. This lack of uniformity of force, speed and temperature can cause the blade to cut all the way through one section of the tile and only partially through another. There is also little or no way to ensure that the cut has gone completely through both overlapping floor coverings. Workers can make another possibly unnecessary stroke and risk inadvertently nicking or gouging the template, inadvertently scoring the surface of the floor coverings or hurting themselves. To ensure the cut is complete, the worker may listen and feel for the tip of the blade scraping against or cutting into the concrete or wood floor, which can quickly dull the blade so that frequent blade changes or sharpenings are necessary.

Although transition caps or covers can be used to cover an unattractive seam between two adjacent floor coverings as in FIG. 1F, these caps are not always desirable. These caps create a ridge that can cause a person to trip and injure themself. This problem is accentuated if the cap becomes loose over time and begins to lift up off the floor. The transition cap also forms a break or discontinuity in the floor design and can adversely impact the appearance of the design. Placing a transition cap over a seam in the middle of a room or along a walkway where a person would not normally expect to find such a cap is not always desirable.

The present invention is intended to solve these and other problems.

BRIEF DESCRIPTION OF THE INVENTION

The present invention pertains to an apparatus and method for marking and continuously cutting different floor coverings to form a uniform seam between them. The apparatus and method are particularly suited for vinyl and linoleum tile floor coverings. The apparatus is secured to a floor at a reference point or along a reference path, and adjusted to hold a marker a specific distance from that reference point or path. The apparatus moves the marker along a specific path of travel to form a border mark on the floor to delineate separate areas of the floor. The different floor coverings are each placed on one of the separate areas so that they each overlap and continuously cover the border mark. Cutting and heating devices are then secured substantially the same distance from the reference point or path as the marker. A drive mechanism propels the apparatus at a desired rate of speed to move the cutting device along the predefined path of travel over the border mark to continuously heat and cut the overlapping floor coverings to form a uniform lap seam between them.

The apparatus has a working section that includes a cutting blade, a blade biasing mechanism, two heaters, and a motor driven wheel that moves the apparatus at a continuous rate of speed along a desired path of travel over the border mark. The apparatus also includes an alignment mechanism that is movably secured to the floor at the reference point or along the reference path. The alignment mechanism guides the working section and blade along the desired path of travel over the border mark. The alignment mechanism is rotatably anchored to the floor or securely mounted on a guide track that is firmly secured to the floor. The rotating version of the alignment mechanism includes a telescoping section to align the working section a desired distance from the reference point.

The apparatus and method are particularly suited for vinyl and linoleum tile floor coverings. Each floor covering is formed by a batch of like-shaped tiles with a specific surface color or style. The apparatus allows the tiles to be arranged and secured to the floor in an intended array before they are cut to form the seam where they meet. Each tile is placed and secured at a position where it is ultimately located when the floor pattern is complete. The apparatus cuts the entire array of overlapping tiles in a single stroke or pass to produce a seam from one end of the array to the other. Cutting the entire array of tiles in this continuous pass creates a uniform seam between the tiles with an attractive and professional appearance. Transition pieces are not required to cover the seam.

The apparatus and method of the present invention are time and labor efficient. Vinyl and linoleum tiles are easily cut in both straight and arcuate manners. The tiles are not scored and broken to fit them together. Templates are not needed, and time is not wasted aligning small sections of cuts. Discontinuities between such sections are avoided. The imprecision, fatigue and safety hazards associated with conventional hand tools and torches are avoided. Nicks and gouges in the edges of the floor coverings along the seam, and unsightly score marks on the surface of the floor coverings are avoided. The resulting arcuate seam is formed by two flushly abutting floor coverings or produces a constant gap between the floor coverings to produce an attractive and professional appearance.

The apparatus continuously heats and cuts through the overlapping tile floor coverings. The apparatus moves at a constant desired rate of speed so that each tile is heated about the same amount to a consistent desired temperature prior to and while being cut. The blade biasing mechanism and drive mechanism are set to produce a constant amount of cutting force between the blade and floor coverings and a constant cutting speed during the entire cut. The relatively slow speed of the apparatus enables the heating units to be set at a power level that will consistently heat the tiles to the desired temperature without scorching or discoloring the tiles. The intensity and danger of a propane flame is avoided. The repetition and misalignments associated with moving a template or heat shield along the cut line is also avoided.

The present invention forms a safe and attractive uniform seam that does not require transition cap. The cut edges of the adjacent floor coverings abut along the seam to produce a physically and aesthetically smooth transition from one floor covering to the other. The upper surfaces of the different floor coverings are planar and there is little or no gap between the floor coverings to cause a person to trip, or into which dirt and debris can collect and cause the tiles to lift up over time. The seam provides a smooth transition between the floor coverings that is safe to walk over and that gives the overall design a clean unobstructed appearance.

Other aspects and advantages of the invention will become apparent upon making reference to the specification, claims and drawings.

BRIEF DESCRIPTION OF THE DRAWINGS

FIG. 9 is a perspective view of a first heating assembly holding an air heating and blowing gun, and showing an enlarged view of its nozzle.

FIG. 10A is a perspective view of a second heating assembly that includes a forward extending radiant heater.

FIG. 10B is a bottom view of the radiant heater.

FIG. 12A is a perspective view of a short, pivoting section for the alignment mechanism for use without a telescoping section.

FIG. 12B is a perspective view of a short pivoting section for the alignment mechanism used with a telescoping section.

FIG. 12C is a perspective view of a long pivot section for the alignment mechanism used with the telescoping section.

FIG. 12D is a perspective view of an even longer pivot section for the alignment mechanism used with the telescoping section.

FIG. 13A is a perspective view of a horseshoe section for the alignment mechanism for negotiating around a column extending from the floor to the ceiling.

FIG. 13B is a perspective view of a first elevated section for the alignment mechanism for negotiating over a projection extending up from the floor.

FIG. 13C is a perspective view of a second elevated section of the alignment mechanism for negotiating over a projection extending up from the floor.

DESCRIPTION OF THE PREFERRED EMBODIMENTS

Figure 1A:
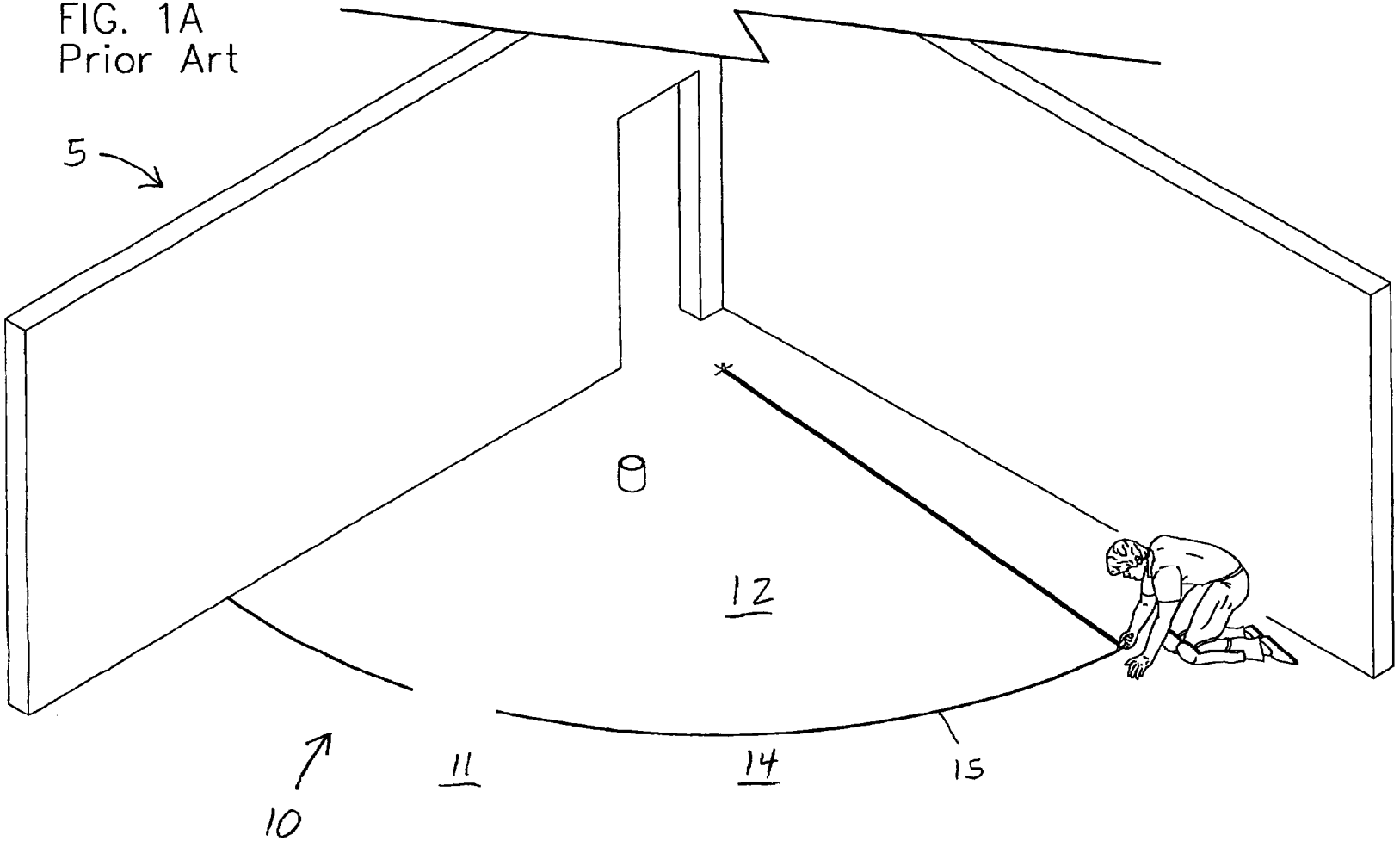
FIG. 1A Prior Art
FIG. 1A is a perspective view of a conventional manner of marking a floor with an arcuate mark to delineate two separate areas of the floor.
Figure 1B:
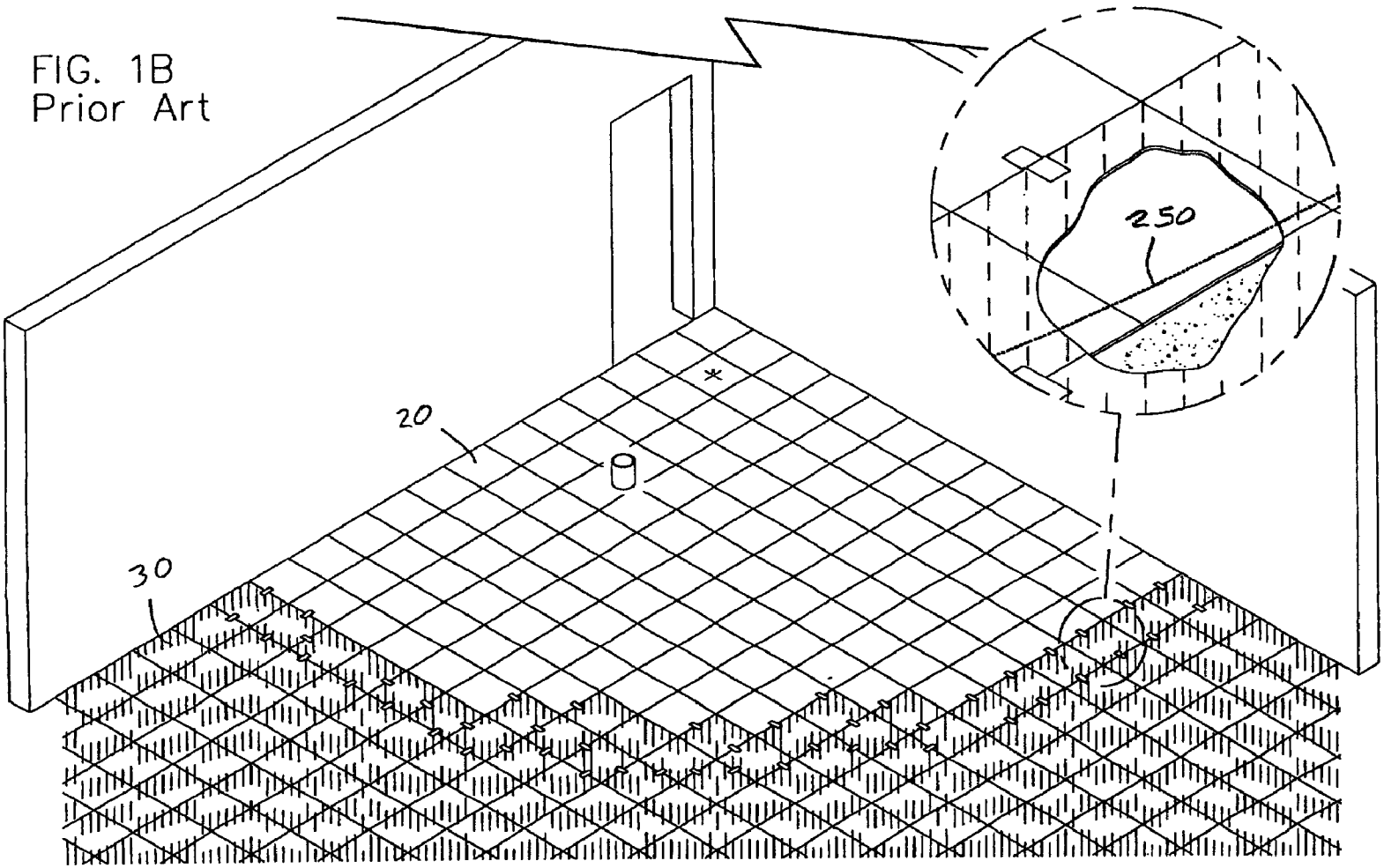
FIG. 1B Prior Art
FIG. 1B is a perspective view of the conventional manner of placing two flooring covers on the separate areas so that they overlap along the arcuate mark.
Figure 1C:
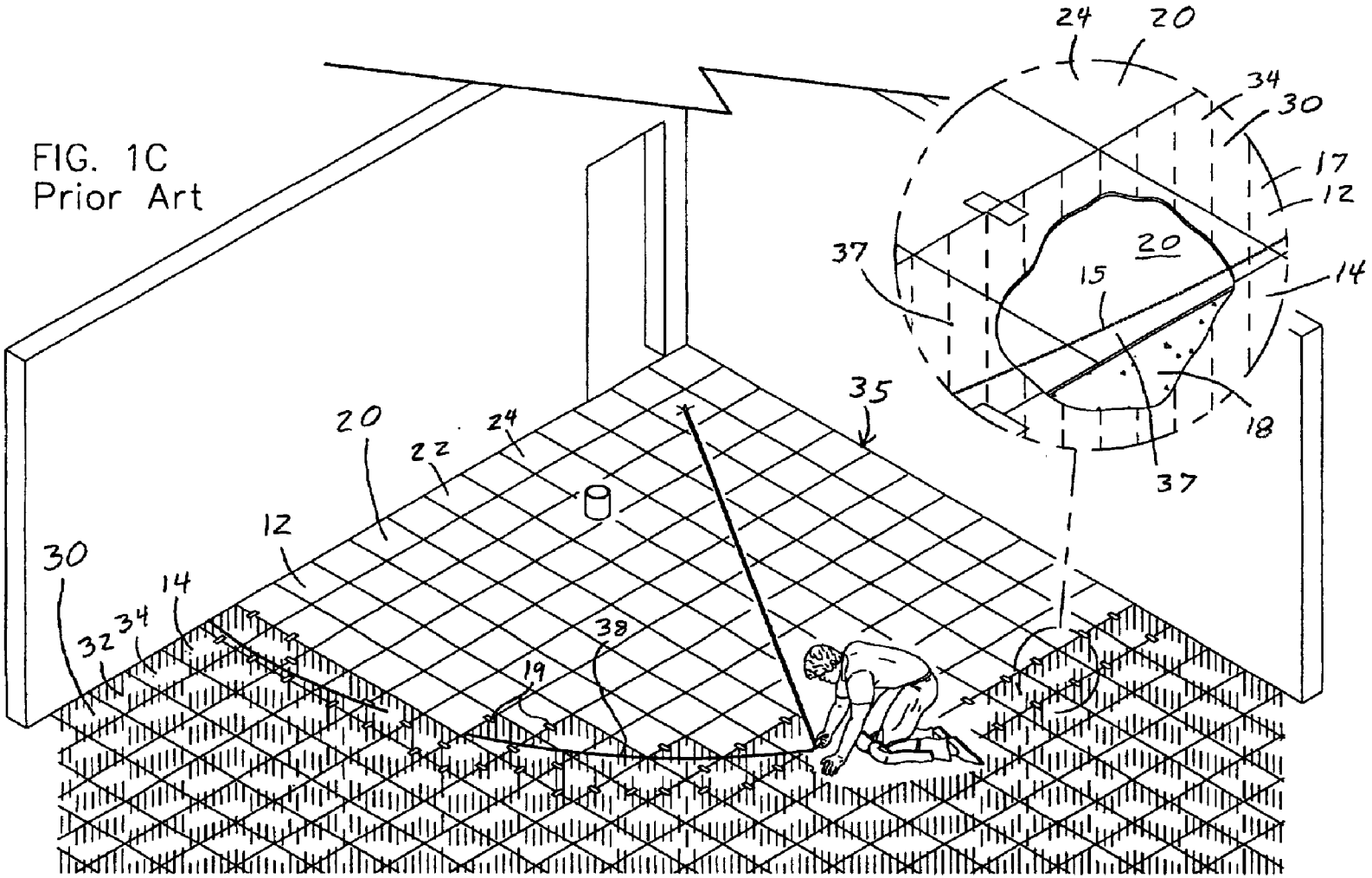
FIG. 1C Prior Art
FIG. 1C is a perspective view showing a second mark being made on the overlapping tiles.
Figure 1D:
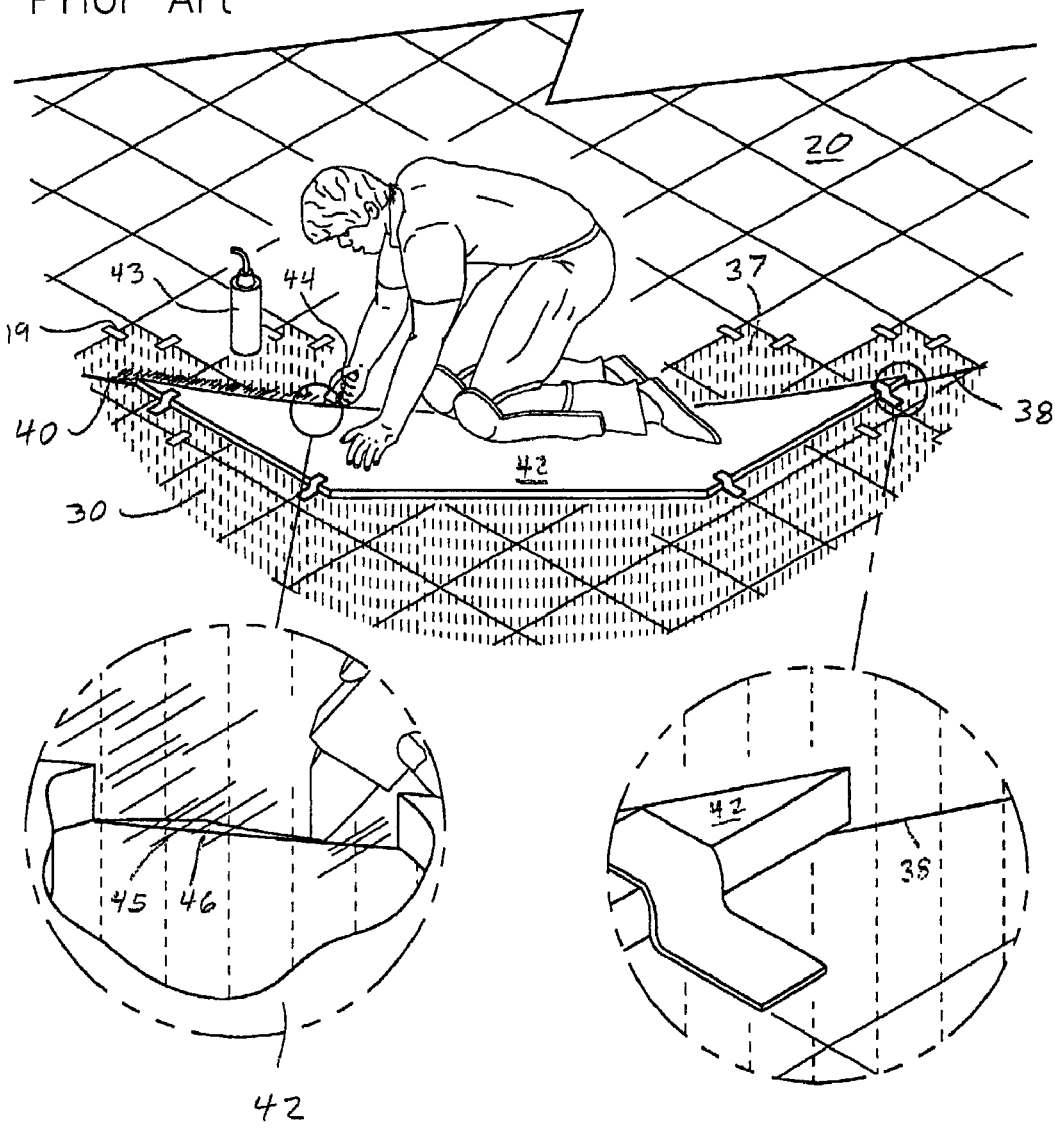
FIG. 1D Prior Art
FIG. 1D is a perspective view of showing a conventional manner of cutting a seam between the overlapping floor coverings using a template aligned along the second mark and a hand tool and propane torch that heat and cut the tiles in an intermittent manner.
Figure 1E:
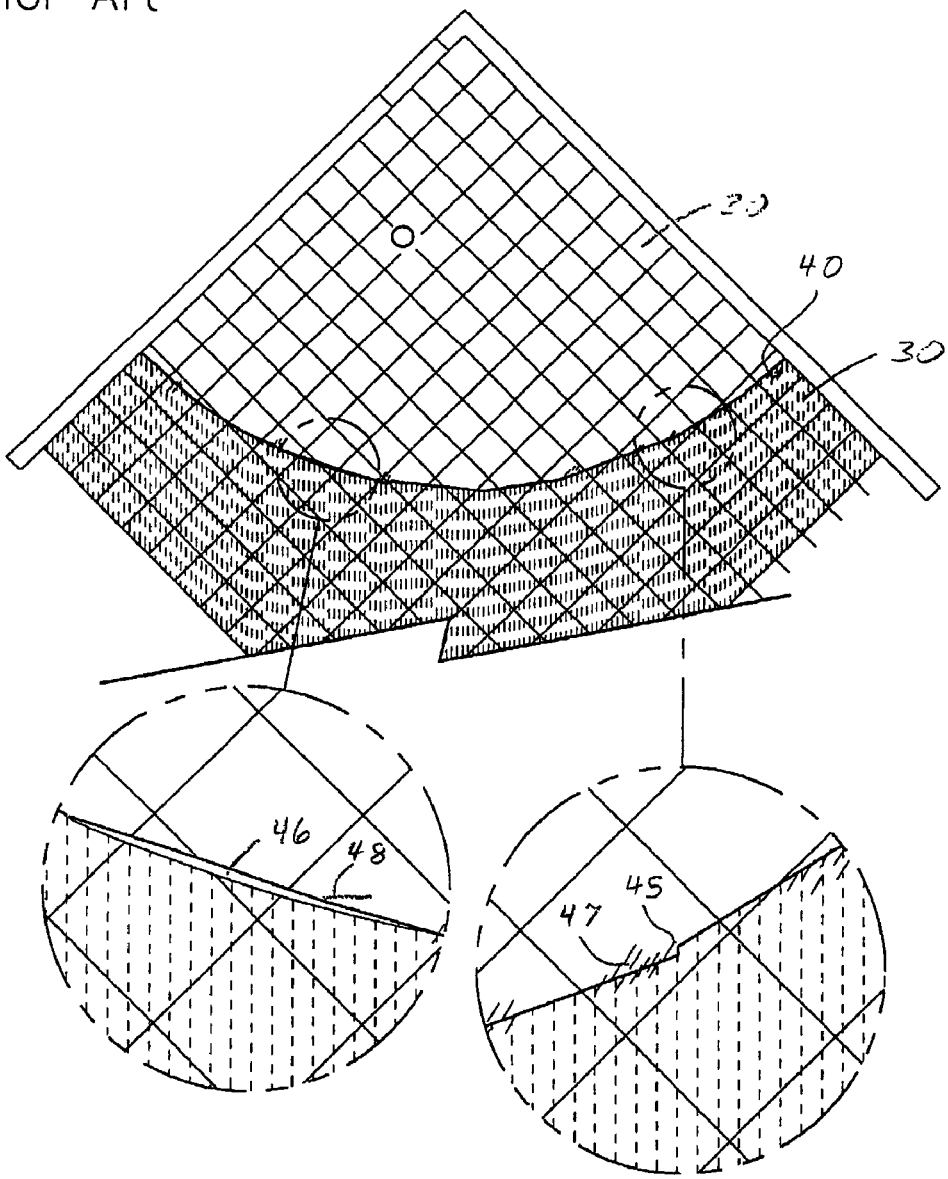
FIG. 1E Prior Art
FIG. 1E is a perspective view showing a conventional floor covering pattern formed by two different floor coverings that abut along a non-uniform seam with sporadic gaps between the edges of the abutting floor coverings and score marks and scorch marks on the upper surface the tiles.
Figure 1F:
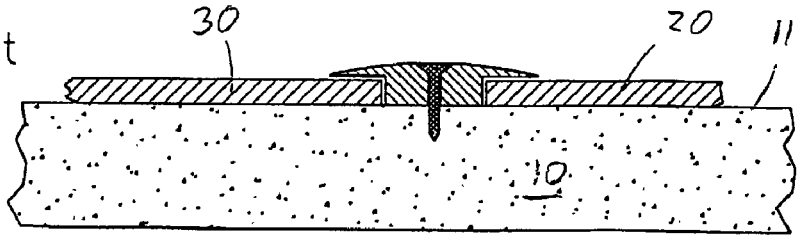
FIG. 1F Prior Art
FIG. 1F is a side sectional view showing a conventional transition plate covering the discontinuous seam and sporadic score marks.

While this invention is susceptible of embodiments in many different forms, the drawings show and the specification describes in detail several preferred embodiments of the invention. It should be understood that the drawings and specification are to be considered an exemplification of the principles of the invention. They are not intended to limit the broad aspects of the invention to the embodiments illustrated.

The present invention relates to an apparatus for marking a floor 10 and lap seaming adjacent floor coverings 20 and 30, and is generally indicated by reference number 50 as shown in FIGS. 2-5. The apparatus is particularly useful in continuously cutting a uniform seam between overlapping vinyl or linoleum tile floor coverings 20 and 30 laid on a surface 11 of the floor 10 in a conventional side-by-side arrangement 35. The apparatus 50 has a movably secured end 52 and free end 54. The movably secured end 52 is rotatably or otherwise guidably secured to the floor 10 at a fixed reference point 55 as in FIG. 2, or along a fixed reference path 56 as in FIG. 5. The free end 54 is free to move along a desired path of travel 58 defined by the reference point 55 or path 56 and the geometry or shape of the apparatus 50 and the manner with which it is secured to the floor 10. Although the apparatus 50 is particularly useful in lap seaming adjacent vinyl or linoleum tile floor coverings 20 and 30 laid in a side-by-side arrangement 35, it should be understood that some aspects of the inventive apparatus could be used to cut or lap seam floor coverings laid in a different arrangement or other types of floor coverings, such as stone tiles, wood boards, large sheets of linoleum, etc.

The marking and lap seaming apparatus 50 has a working section 60 with a frame 61 that supports and connects its various working components discussed below. The frame 61 is robustly designed to support the weight of these various components and is preferably made of metal. The frame 61 includes two parallel, spaced apart tubes 62 and 63 that are rigidly joined by a perpendicular cross plate 64 and two mounting brackets 65 and 66. The tubes 62 and 63 are preferably spaced about six inches apart. The support tubes 62 and 63 and mounting brackets 65 and 66 are aligned substantially parallel to and about an inch above the surface 12 of the floor 10. The forward tube 62 is preferably marked with indicia (not shown) for positioning the working components as discussed below. In the embodiment of the apparatus 50 shown in FIG. 2, the frame 61 and its support tubes 62 and 63 are about three feet long. In a second embodiment of the apparatus 50 shown in FIG. 5, the frame 61 and its support tubes 62 and 63 are about two feet long.

An alignment mechanism 70 aligns and movingly secures the secured end 52 of the apparatus 50 at the fixed reference point 55 or on the reference path 56. The alignment mechanism 70 maintains the working section 60 of the apparatus 50 a desired fixed distance from the reference point 55 or path 56 as the apparatus moves along its path of travel 58. The alignment mechanism 70 also maintains the working section 60 in a fixed orientation to the reference point 55 or path 56 as the apparatus 50 moves along its path of travel 58. Although the alignment mechanism 70 can take various forms without departing from the broad aspects of the present invention, the figures show and the following describes two embodiments with the understanding that the invention is not limited to these two embodiments.

Figure 2:
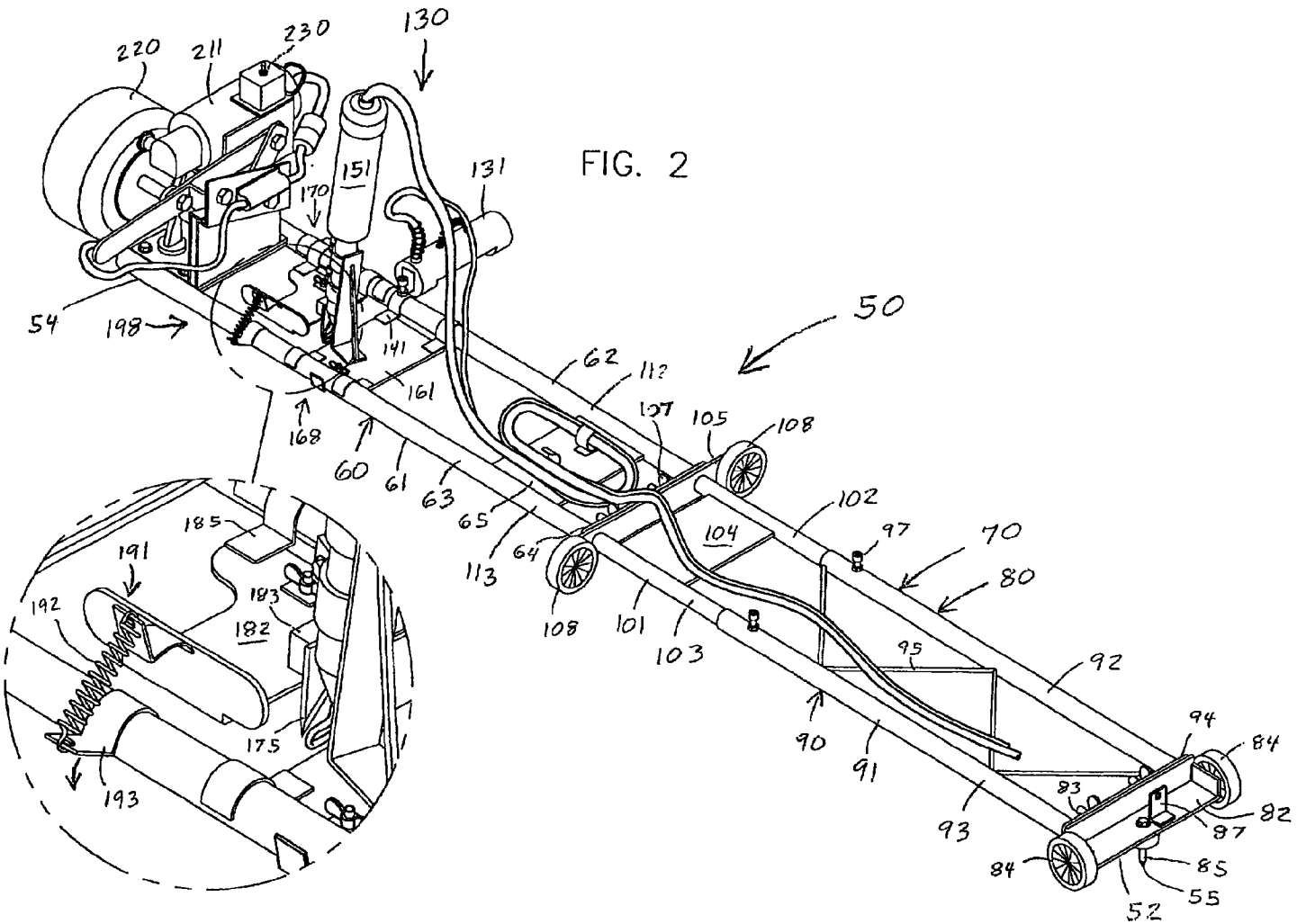
FIG. 2 is a perspective view of the inventive floor covering cutting apparatus with a rotating alignment mechanism and a working section with a frame holding a cutting device, two heaters and a wheel drive mechanism in their engaged positions.
Figure 3:
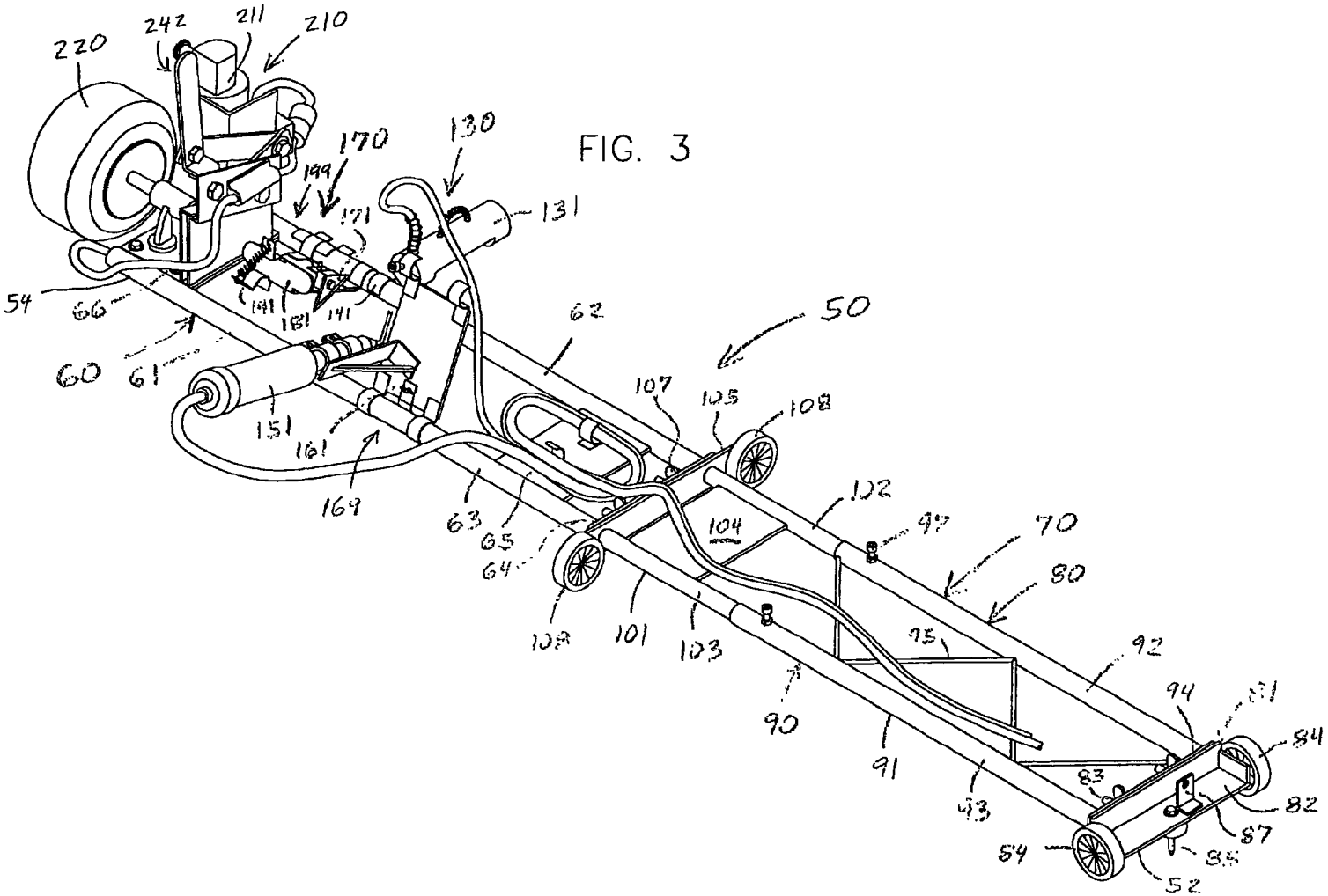
FIG. 3 is a perspective view of the inventive floor covering cutting apparatus with the cutting device, one heater and the drive mechanism in disengaged positions.

A first embodiment of the alignment mechanism 70 is shown in FIGS. 2 and 3. In this embodiment, the alignment mechanism 70 takes the form of a rotatably anchored, telescoping assembly 80 that includes anchor and telescoping assemblies 81 and 90. The anchor assembly 81 has an L-shaped mounting plate 82 with a pair of spaced coupling bolts and wing nuts 83 for rigidly connecting the anchor assembly 81 to the telescoping section 90. A pair of wheels 84 are mounted to the sides of the mounting plate 82. A vertically oriented pivot pin or anchoring screw 85 is located at the middle of the plate 82. The axles of the wheels 84 are linearly aligned with each other and the axis of the pivot pin 85. The pivot pin 85 is aligned with and anchored or otherwise rigidly secured to the floor 10 at reference point 55. The pivot pin 85 is pivotally or rotatably connected to the middle of the mounting plate 82 to allow the anchor assembly 81 to pivot or rotate about the reference point 55 and pivot pin. An alignment bracket 87 is rigidly secured to the mounting plate 82 proximal the pivot pin 85. One end of a measuring device, such as a tap measure, is aligned with the bracket 87 to adjust the telescoping assembly 90 so that the working section 60 and its components are spaced a desired distance from the reference point 55.

The telescoping assembly 90 includes a fixed section 91 and a telescoping section 101. The fixed section 91 is formed by two parallel, spaced apart tubes 92 and 93 that are rigidly joined by a perpendicular cross plate 94 and a set of diagonal cross rods 95. The plate 94 has two spaced holes for receiving coupling bolts 83 and rigidly connecting it to mounting bracket 82. Each tube 92 and 93 has a set screw 97. The telescoping section 101 includes two parallel, spaced apart tubes 102 and 103 rigidly joined by perpendicular cross plate 104 and cross bracket 105. The tubes 92 and 93 are sized and spaced to matingly and telescopingly receive tubes 102 and 103, respectively. Each tube 92 or 93 is adjustably and linearly aligned with its mating tube 102 or 103. Set screws 97 are tightened to clamp or otherwise rigidly connect the sections 91 and 101 together.

The cross plate 104 of the telescoping section 101 has a pair of spaced bolts and set screws 107 for rigidly connecting the telescoping assembly 90 to the cross plate 64 of the working section 60. The cross plate 104 is also provided with a pair of support wheels 108. The axle of each support wheel 108 is rigidly mounted to the cross plate 104. Each axle is parallel to tubes 102 and 103 and each wheel 108 is parallel to the cross plate 104. When the fixed and telescoping sections 91 and 101 are rigidly secured together, forward tubes 62, 92 and 102, and trailing tubes 63, 93 and 103 form a set of rigid, substantially linear and parallel alignment members 112 and 113 that extend from the secured end 52 of the apparatus 50 to its free end 54. These forward and trailing alignment members 112 and 113 are spaced about five inches apart. The working section 60 remains radially oriented to the reference point 55 as the apparatus 50 moves along the path of travel 58 around the reference point.

Figure 5:
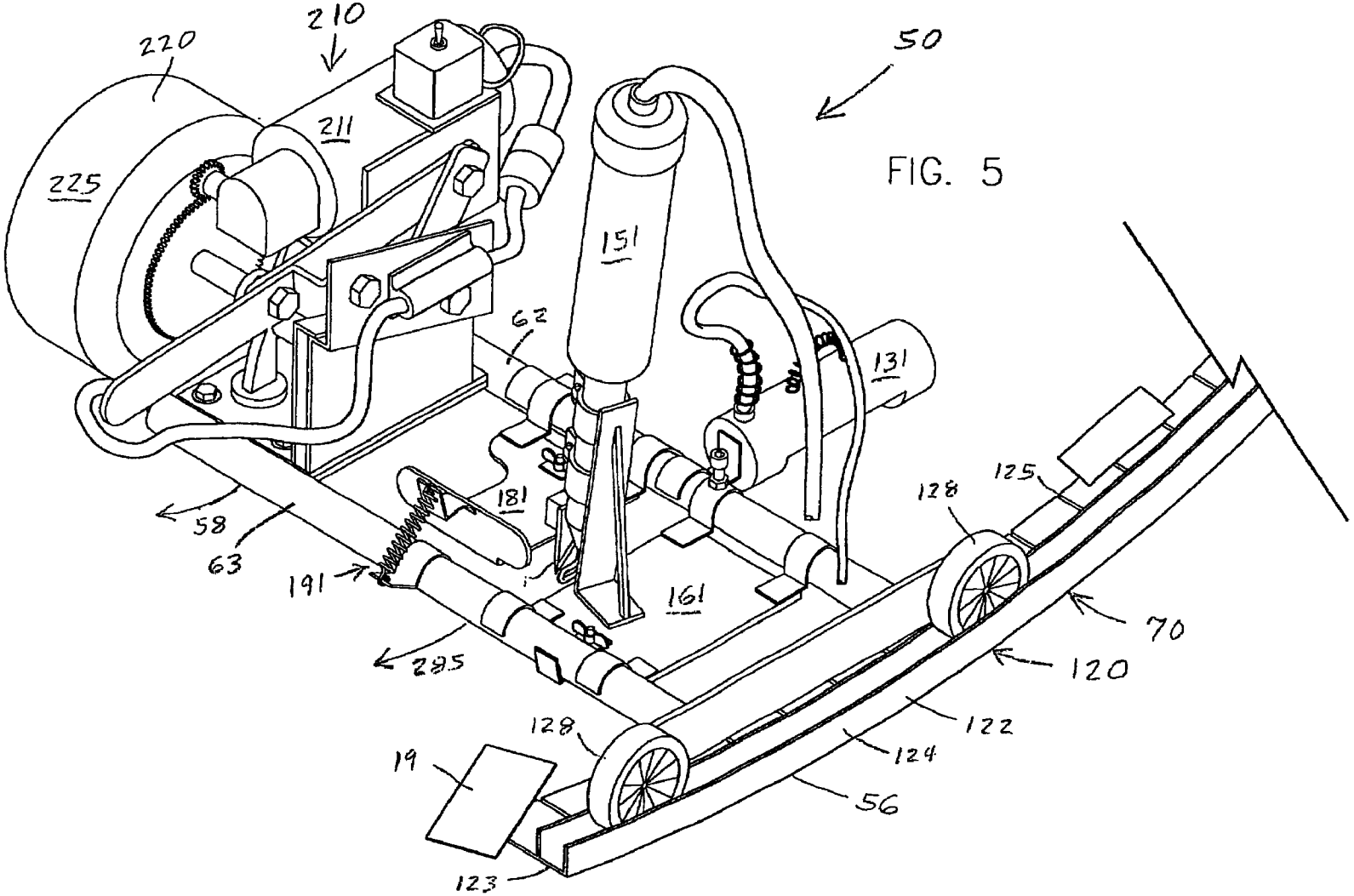
FIG. 5 is a perspective view of the inventive floor covering cutting apparatus with a track and wheel alignment mechanism and a working section with a shorter frame, and wherein the track defines a convex path.

A second embodiment of the alignment mechanism 70 is shown in FIG. 5. In this embodiment, the alignment mechanism 70 takes the form of a track and wheel assembly 120. The track and wheel assembly 120 preferably includes a commercially available and flexible track or channel 122. The flexible track 122 has a U-shaped cross section formed by a horizontal base 123 and two opposed vertical side walls 124. The side walls 124 are notched at spaced increments along the length of the track 122 to give the track its desired degree of flexibility. The notches 125 are preferably fairly close together so that the track 122 can be shaped into a substantially uniform arcuate shape. The flexible track 122 is fixedly secured to the floor 10 along the desired layout or reference path 56. A pair of wheels 128 are firmly mounted to the cross plate 64 of the frame 61 of the working section 60. The axles of the wheels 124 are in substantially parallel alignment with the tubes 62 and 63 of the frame 61. The wheels 128 are in substantially parallel alignment with each other. The wheels 128 are sized to snuggly fit between the side walls 124 of the track 122 and smoothly roll along its base 123. The axles of the wheels 128 are allowed a degree of pivot with respect to the cross plate 64 to allow them to accommodate the curved shape of the track 122. The spaced apart wheels 128 maintain the working portion 60 in a perpendicular orientation to the track 122 and path 56 as the apparatus 50 moves along the path of travel 58 defined by the track.

The working components of the apparatus 50 include a heating assembly 130, a cutting assembly 170 and a drive mechanism 210 as shown in FIGS. 2 and 5. Each component 130, 170 and 210 is rigidly secured to the frame 61 of the working section 60 in a preferably removable manner. The drive mechanism 210 is run in either forward or reverse to move the apparatus 50 in either direction along its path of travel 58. The working section 60 can weigh as little as about four pounds when the components are secured, but additional ballast weight can be secured as needed. Although the heating and cutting assemblies 130 and 170 are described to be secured to the forward tube or side 62 of the frame 61, these components can also be secured to the trailing tube 63 and the drive mechanism 210 run in reverse to move the apparatus in an opposite direction along the path of travel 58.

The heating assembly 130 has two heating sources or devices 131 and 151 for heating the floor coverings 20 and 30 at a controlled and pre-selected rate. As discussed below, the heating assembly 130 heats a localized area of the overlapping floor coverings 20 and 30 to a temperature that facilitates the ease of the cut without scorching or otherwise discoloring portions of the floor coverings forming the finished floor covering pattern. Although the heating devices 131 and 151 are shown and described to be an electric powered radiant heat lamp 131 and an electric powered heat gun 151 as in FIGS. 9 and 10A, one of ordinary skill in the art should understand that other types of heating devices could be used without departing from the overall aspect of the invention.

The heat lamp 131 is cantilevered from the leading side 62 of the working section 60 a desired distance in front of the cutting device 170. The housing 132 has a secured end 133 and a cantilevered end 134. The bottom side of the lamp 131 has a radiant heat source such as a lamp or bulb 135 that provides a heat emitting area 136 with a center 137 and a predetermined length $H_L$ of about four to twelve (4 to 12) inches as shown in FIG. 10B. Power is supplied to the lamp via an electric cord 138. The heat lamp 131 is selectively adjustable to produce about 0 to 100 BTUs of heat per minute. The radiant bulb 135 is a conventional heat bulb, such as those manufactured by Westinghouse using about 550 Watts of energy and having an operating temperature of up to about 500° F.

The heat lamp 131 is mounted to the frame 61 of the working section 60 via a mounting assembly 141 that includes a clip or clamp 142 with a U-shaped portion that snuggly fits or grips the leading tube 62. The clamp 142 includes a set screw that rigidly secures the lamp 131 to the frame 60 when tightened. The set screw is loosened to reposition the heat lamp 131 on the support tube 62 such as by sliding the heat lamp up or down along the length of tube. The heat lamp 131 is selectively aligned at a position generally in front of the cutting assembly 170 so that the bulb 135 is parallel to and about ½ inch above the upper floor covering 30.

The heat gun 151 is secured to and positioned between the front frame member 62 and the rear frame member 83. The heat gun 151 has a housing 152 and a nozzle 153 through which a stream of heated air or gas is blown or otherwise expelled from the gun as best shown in FIG. 9. The nozzle 153 has a generally constant inside diameter of about 3/16 inch. Its tip 154 is pointed or otherwise aimed to blow the stream of heated air slightly downward and in a generally forward direction along and generally parallel over the surface of the floor 10 and tiles 20 and 30. The tip 154 of the nozzle 153 is about ⅛ inch from the upper floor covering 30. The nozzle 153 also has an oblong side hole 155 with a diameter of about ⅛ to 3/16 inch for emitting a second stream of heated air or gas as discussed below. The side hole 155 is located near the tip 154 of the nozzle. Power is supplied to the heat gun 151 via an electric cord 158.

The heat gun 151 selectively produces about 0 to 100 BTUs per minute and is adjustable to supply heated air in the range of about 0 to 600° F. The heat gun 151 blows the heated air at a relatively slow rate of about one foot per second or roughly about one to two (1 to 2) cubic feet per minute. The heated air stream rapidly dissipates upon leaving the nozzle 153. Depending on the volumetric air flow involved, the speed and temperature of the stream of air substantially fully dissipates by about three feet from the tip 154 of the nozzle. The exit temperature at the nozzle is preferably about 400° F. and dissipates to about 150° F. at a distance of eight inches from the nozzle. A heat gun 151 of this type is manufactured by K. Leister of Switzerland and sold as Model No. 44B6.

The heat gun 151 is mounted to the frame 61 of the working section 60 via a mounting assembly 161. The mounting assembly 161 includes a mounting plate 162 and two sets of opposed clips 163 that snuggly fit or grip the front frame member 62 and the rear frame member 63. A clamp 164 and corresponding set screw are provided to pivotally secure the mounting plate 162 and heat gun 151 to the trailing frame member 63. A second set screw is provided on one of the forward clips 163 to firmly secure the plate 162 and gun 151 to the front frame member 61 when that screw is tightened. The set screws are loosened to position the heat lamp 131 on the working section 60 such as by sliding it up or down along the length of tube 62. The indicia along the length of the working section 60 are used to align the heat gun 151 at a desired position substantially in line with the heat lamp 131.

The nozzle 153 of the heat gun 151 extends below the frame 61 in order to direct the stream of heated air in a forward direction just above the surface of the overlapping floor covering 20 and 30. The heat gun 151 is secured to the mounting plate via a generally vertical bracket 165. The bracket 165 includes a height adjustment mechanism 166 secured to the housing 152 that allows the heat gun 151 and its nozzle 153 to be raised and lowered when the mounting plate 162 is firmly secured to the frame 61 in a heating or engaged position 168 shown in FIGS. 2 and 5. When the apparatus 50 is not in use, the forward set screw is loosened and the mounting plate 162 is pivoted or rotated up to a tilted or disengaged position 169 shown in FIG. 3. When in the disengaged position 169, the nozzle 153 is pulled up away from the floor 10 where it can be damaged, and moved to a position between or above the frame 61.

Figure 7:
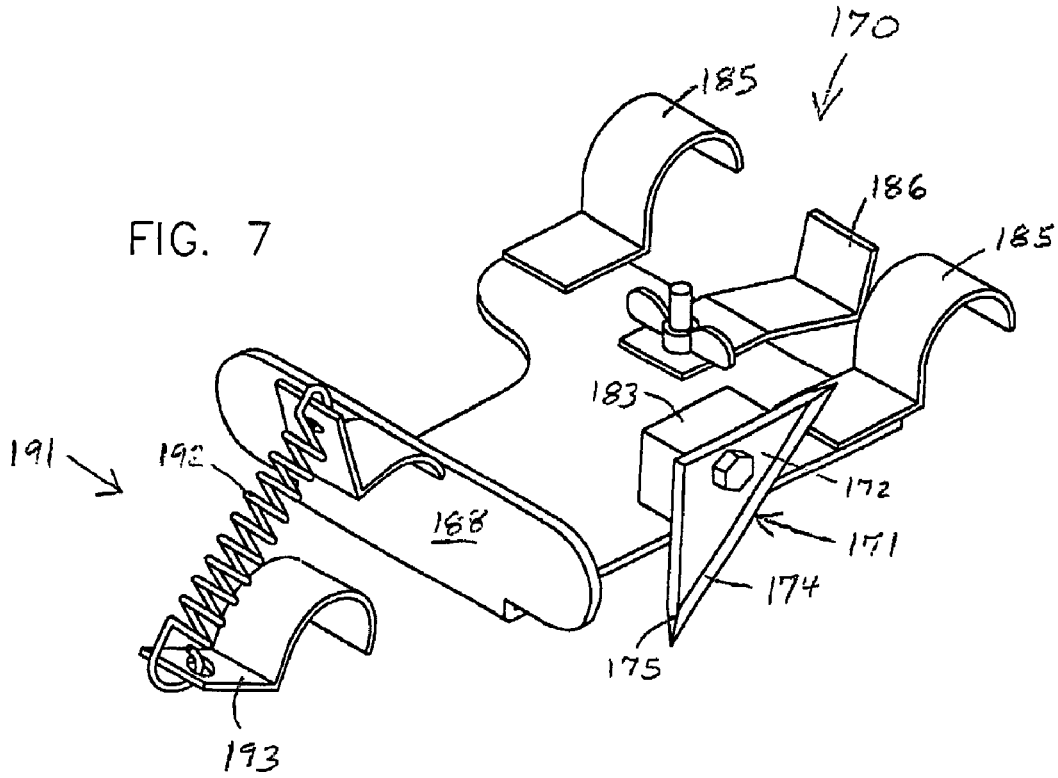
FIG. 7 is a perspective view of the cutting assembly with a blade and spring biasing assembly.
Figure 8:
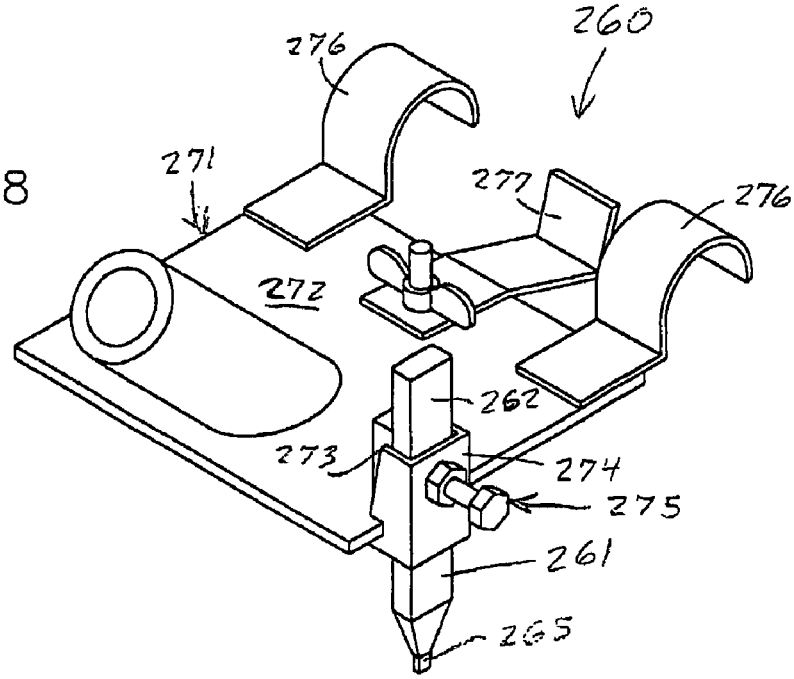
FIG. 8 is a perspective view of the floor marking assembly with a marker having a writing tip for engaging the floor.
Figure 11A:
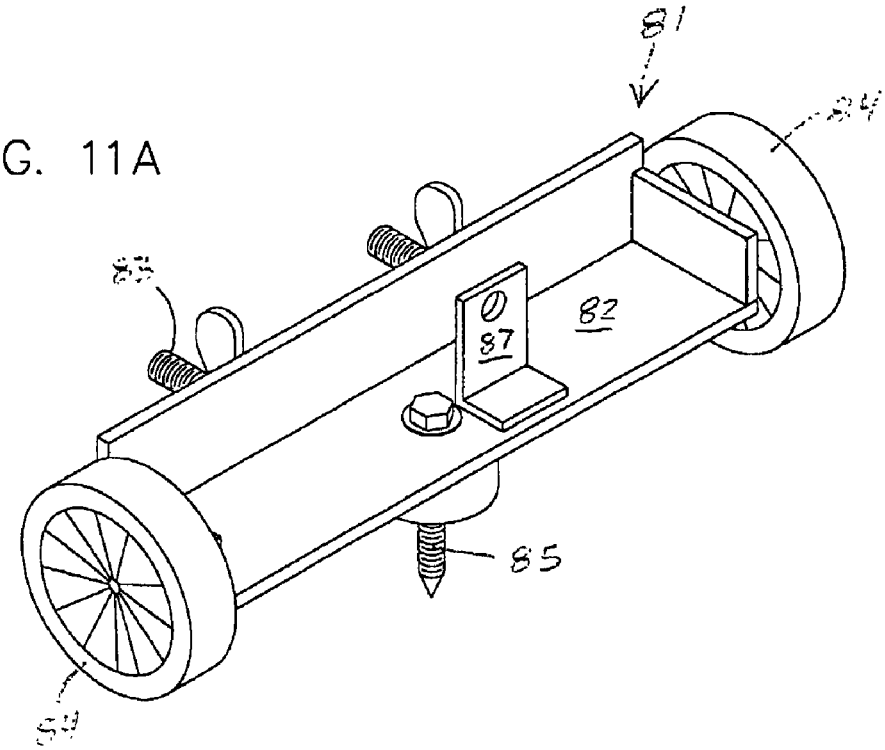
FIG. 11A is a perspective view of the pivoting anchor assembly of the pivoting embodiment of the alignment mechanism.
Figure 11B:
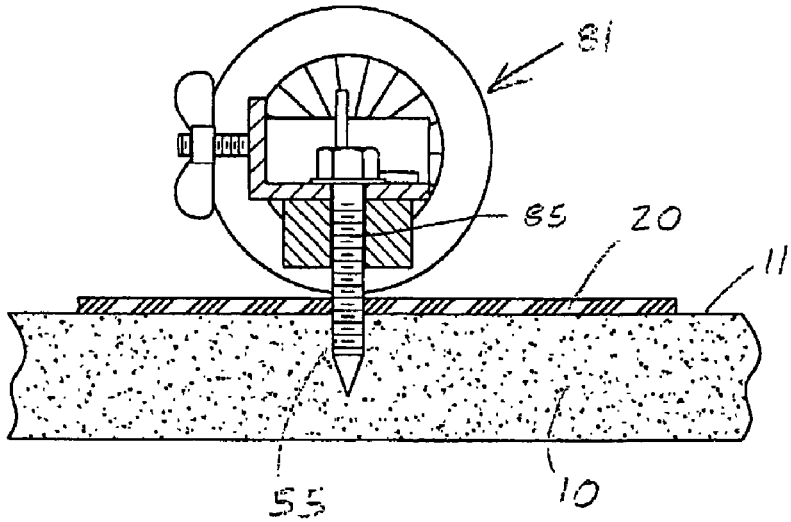
FIG. 11B is a side, cross-sectional view of pivoting anchor assembly with its pivot pin rigidly secured into the floor.

The cutting assembly 170 includes a cutting tool such as a blade or knife 171 having a base 172 and a cutting edge 174 with a tip 175 as best shown in FIG. 7. The blade 171 is rigidly held by a mounting assembly 181 located between and secured to the frame 61 of the working section 60. The mounting assembly 181 includes a plate 182 with a mounting block 183 to which the blade 171 is bolted or otherwise rigidly secured. The plate 182 is secured to the forward frame member 62 via two spaced apart clips 185 and a central clamp 186. The clamp 186 is secured to the plate 182 via a bolt and wing nut that is tightened and loosened as needed. The wing nut is tightened to provide a desired amount of griping force to the clamp 186 to maintain the plate 182 at a position generally parallel to the floor 10 and frame members 62 and 63. The plate 182 also includes a rearward, upwardly extending bracket 188. The upper end of the bracket 188 extends above the frame members 62 and 63.

The cutting assembly 170 has a biasing mechanism 191 that pushes or otherwise forces the blade 171 into cutting engagement with the floor coverings 20 and 30. The biasing mechanism 191 includes a biasing device such as a spring 192 and a clip 193. The spring 192 shown in the illustrated embodiments is a conventional helical spring capable of producing about four to nine (4 to 9) pounds of force on the blade 171. However, it should be noted that when the cutting tool 50 or working section 60 is weighted down or otherwise constructed to be relatively heavy, such as over 100 pounds, the spring 192 can be sized to selectively produce over 100 pounds of force without departing from the invention. The clip 193 is firmly secured to the trailing frame member 63 via a locking screw (not shown). The locking screw is loosened to align the clip 193 at a desired position on the frame member 63 such as by sliding it along the length of the frame member.

The spring 192 has two ends. One end of the spring 192 is secured to the upper end of rear bracket 188. The other end of the spring 192 is secured to the clip 193. The size and strength of the spring 192 and the orientation of the clip 193 on the frame member 63 is selected to obtain a desired amount of downward force for pushing the blade 171 into cutting engagement with the floor coverings 20 and 30. The clip 193 can be selectively rotated and fixed at a desired position to increase or decrease the stretched length of the spring 192 and thus the biasing force with which the blade 171 is pushed into the floor coverings 20 and 30. The biasing assembly 191 is capable of pressing the blade 171 into the floor coverings 20 and 30 with a force in the range of about 5 to over 100 pounds. The depth to which the blade 171 cuts into or through the floor coverings 20 and 30 is a function of this force and other factors as discussed below.

The blade 171 extends below the frame 61 of the working section 60 in order to engage the floor covering 20 or 30. The biasing assembly 191 biases the blade 171 down into an engaged position 198 in which it can cuttingly engage the floor coverings 20 and 30 as shown in FIGS. 2 and 14E. When in its engaged position 198, the nozzle 153 of the heat gun 151 is positioned along side and spaced about ⅛ inch from the blade 171. The hole 155 in the side of the nozzle 153 is aimed or otherwise directed at the base 172 of the blade 171 toward its tip 175. The heated air emitted from this side hole 155 heats the blade 171 to a temperature approaching that of the exit temperature of the heated air emitted from the heat gun 151. It should be noted that the blade 171 can also be a source of heat by directly heating the blade, such as by an electrically powered heating element positioned on the blade. When the cutting assembly 170 is not in use, the clip 193 is released from the trailing frame 83 or 113 and the mounting plate 182 is pivoted or rotated up to a tilted or disengaged position 199. When in the disengaged position 199, the blade 171 is pulled up away from the floor 10 and moved to a position between or above the frame 61 to protect it from damage.

Figure 6A:
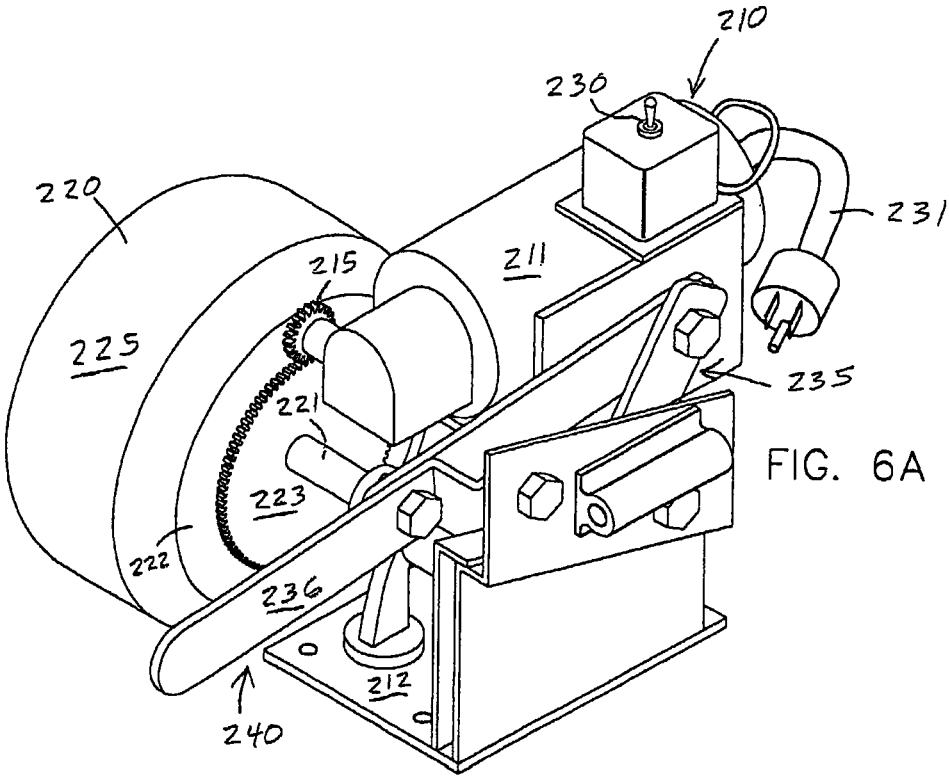
FIG. 6A is a perspective view of the wheel drive mechanism in its engaged position.

The drive assembly 210 controls the rate of speed that the apparatus 50 moves along the path of travel 58. The drive assembly 210 includes a drive motor 211 mounted on a plate 212 that is bolted to cross plate 66 as shown in FIG. 6A. The drive motor 211 has an outer housing and a drive gear 215 that drivingly rotates a drive wheel 220. The drive wheel 220 has an axle 221 that is rotatingly connected to the plate 212. The drive wheel 220 has a hub 222 with a geared rim 223 to which the drive gear 215 mates. The wheel 220 has an outer surface 225 with a width of about two inches and a diameter of about five inches to gripingly engage the upper surface of the floor 10 or floor covering 30. The motor 211 has an on/off control switch 230 and an electric cord 231 through which power is supplied. The speed of the motor 211 and the rotating speed of the drive wheel 220 are preferably controlled by a speed control knob (not shown). An acceptable drive motor 211 is manufactured by Bodine Electric Company and sold as Model No. H0086026.

Figure 6B:
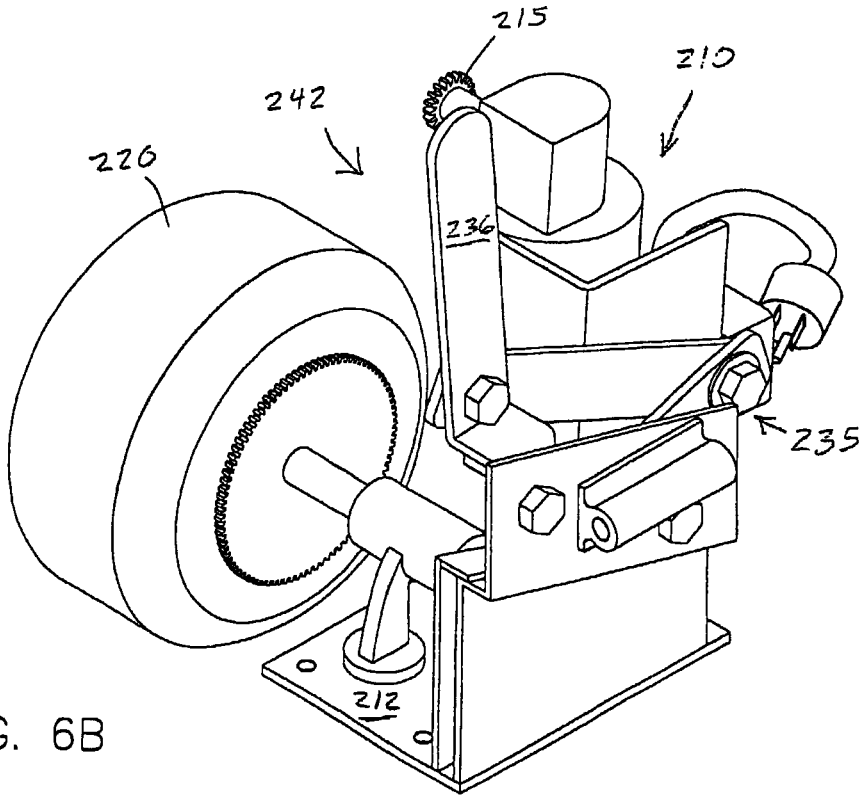
FIG. 6B is a perspective view of the wheel drive mechanism in its disengaged position

The drive assembly 210 is geared to rotate the drive wheel 220 at a speed of about two revolutions per minute so that the outer or free end 54 of the apparatus 50 moves at a speed of about three feet per minute. The speed of the apparatus 50 is preferably selectively adjustable between speeds of about one to twenty (1 to 20) feet per minute. The drive assembly 210 is provided with a pivot mechanism 235 and handle 236 for pivoting the drive gear 215 between an engaged position 240 in which it drivingly mates with the geared rim 223 of the wheel 220 as shown in FIGS. 2 and 6A, and a disengaged position 242 in which it disengages the wheel so that no power is supplied to the wheel as shown in FIGS. 3 and 6B.

When the apparatus 50 is set to move at three feet per minute, the upper floor covering 30 is in radiant heat transmitting communication with the heat emitting area 136 of the heat lamp 131 for about 15 to 18 seconds, and is in convection heat transmitting communication with the elevated temperature of the heated air stream emitted from the tip 154 of the nozzle 153 of the heat gun 151 for another 6 to 8 second prior to engaging the blade 171. The lower floor covering 20 is in conductive heat transmitting communication with and is conductively heated by the heated upper floor covering 30 directly above it. The blade 171 is in conductive heat transmitting engagement with both floor coverings 20 and 30 as they are being cut. The cutting edge 174 near the tip 175 of the blade 171 should be kept at or below 140° F. so that it does not scorch or otherwise discolor the tiles 20 and 30 along the cut.

The heat sources 131 and 151 preferably heat the conventional tile floor coverings 20 and 30 in the region to be cut to a temperature of between about 90 to 140° F., each floor covering being preferably heated to 120° F. When the room 5 and floor 10 are at a normal or ambient temperature of about 68° F., the upper tiles 30 are heated to about 120 to 140° F. in the region being cut, and the lower tiles 20 are heated to about 80 to 120° F. in the region being cut. The upper tiles 30 are heated to a higher temperature than the lower tiles because they heated directly by the heat lamp 131 and heat gun 151. The difference in temperature is believed to be due to the time needed to conduct heat through and between the tiles. Each conventional tile 20 and 30 is about ⅛ inch thick. The slower the apparatus 50 moves, the more uniform the temperatures will be between the upper and lower tiles 20 and 30.

The discharge opening or tip 154 of the nozzle 153 of the heat gun 151 is preferably about ¼ inch to the side of the blade 171. The nozzle 153 is placed over the portion 37 of the tile 30 being trimmed away or discarded. The exit temperature of the heated air stream is preferably set above 140° F. When the apparatus 50 is moving at three feet per minute, the surface temperature of the upper tile 30 is heated to about 160 to 200° F. The heated air stream exiting the tip 154 of the nozzle 153 scorches or otherwise discolors the trimmed or scrap portion 37 of the tile 30, but not the region of the tile 30 on the other side of the cut that remains part of the desired floor covering pattern. The heat gun 151 is set so that the heated air stream exiting the side opening 155 heats the blade 171 so that the cutting edge 174 of the tip 175 remains at or below 140° F.

Figure 4:
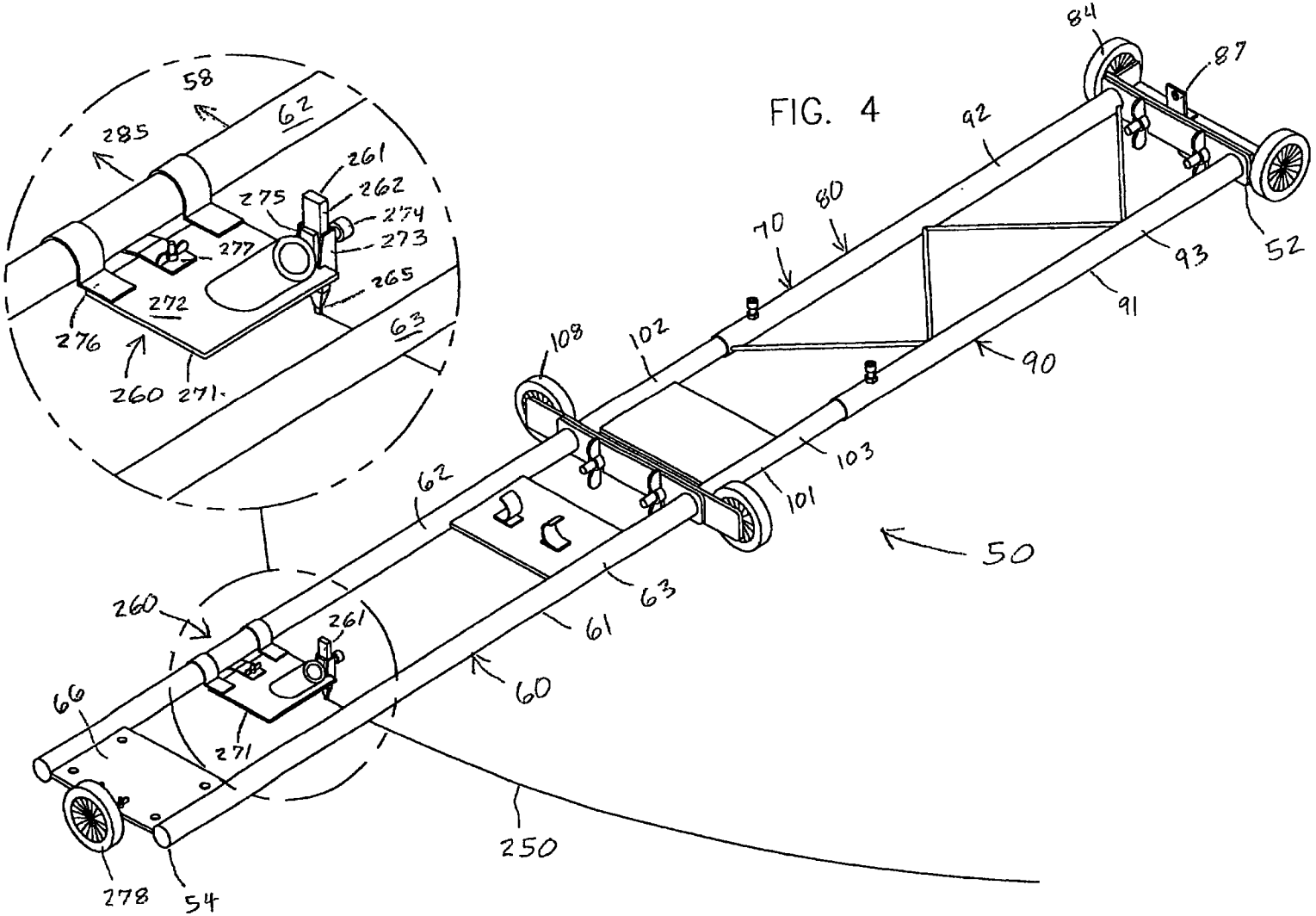
FIG. 4 is a perspective view of the inventive apparatus converted to mark a floor, the apparatus having a marking assembly with a marker in lieu of the cutting device, heaters and drive mechanism.

The apparatus 50 is converted or otherwise set to mark the floor 10 with a border mark 250 as shown in FIG. 4. The working section 60 remains secured to the alignment mechanism 70. The heating assembly 130, cutting assembly 170 and drive assembly 210 are removed from the working section 60. A marking assembly 260 is then secured to the working section 60 between the forward and trailing frame members 62 and 63. The marking assembly 260 includes a marker 261 with a shaft 262 and writing tip 265. The marker 261 is secured to the frame 61 of the working section 60 via a mounting assembly 271. The mounting assembly 271 has a plate 272 and a mounting block 273 with a clamp 274. The marker 271 is secured to the clamp 274. The clamp 274 is tightened to fix the position of the marker 261, or loosened to ride up or down the block 273 to selectively adjust the marker up and down. The block 273 and clamp 274 serve as a height adjustment mechanism 275 for the marker 271. The plate 272 is secured to the forward frame member 62 by a pair of clips 276 and a clamp 277. A wheel 278 is secured to the cross plate 66 in place of drive wheel 220. The height adjustment mechanism 275 is lowered so that the writing or marking tip 265 writingly or otherwise markingly engages the floor 10, or raised so that the tip 265 releases from the floor.

The heating assembly 130, cutting assembly 170 and marking assembly 210 are each slidably secured to the frame 60 so that they can be selectively positioned at various desired positions along the length of its forward or trailing tubes 62 and 63. This slidability gives the working portion 60 of the apparatus 50 a degree of adjustability independent of where the apparatus 50 is secured to the floor 10 at the reference point 55 or path 56. The apparatus 50 is used to form a single uniform seam 280 as in FIGS. 14A-D, or two or more concentric uniform seams without moving the apparatus 50 from its reference point 55 or path 56 as in FIGS. 15A-C. The indicia on the working section 60 are used to note or otherwise log the position of the marker 261 and its writing tip 265 on the working section 60. The indicia facilitate positioning the tip 175 of the blade 171 on the working section 60 in the same or substantially the same orientation or distance from the reference point 55 or path 56 as the tip 265 of the marker 261, so that both the blade and marker move along the same or substantially the same path of travel 285. As the blade 171 moves along its defined path of travel 285, its tip 175 passes directly over the border mark 250.

The apparatus 50 has been shown and described as either being equipped with the heating assembly 130, cutting assembly 150 and drive mechanism 210, or the marking assembly 260. However, it should be understood that the broad aspect of the apparatus 50 encompasses each of these components being secured to the working section 60 at the same time. When the marker 261 is in its engaged position with the writing tip 265 engaging the floor 10, the heating and cutting assemblies 130 and 150 are in their disengaged positions 169 and 199, and vice versa. The drive mechanism 210 can also be in its disengaged position 242 when using the marker 261.

The alignment mechanism 70 includes a variety of attachments 291-297 for adjusting the distance of the working section 60 from the reference point 55. For example, the telescoping assembly 90 can take the form of a single component such as a short section 291 as shown in FIG. 12A. Section 291 is secured directly to both the working section 60 and the anchor mechanism 80. The telescoping portion 90 can also utilize telescoping sections of various lengths such as a short, medium or long telescoping section 292, 293 or 294, respectively as shown in FIGS. 12B-D. The alignment mechanism 70 can also use a variety of attachments for negotiating around columns or projections in the floor 10. A horseshoe attachment 295 is useful in negotiating around a column that extends from the floor 10 to the ceiling of the building or room 5. A bridge such as bridges 296 or 297 are useful for negotiating over a projection extending up from the floor 10.

Process of Marking the Floor and Lap Seaming the Floor Coverings

Figure 17A:
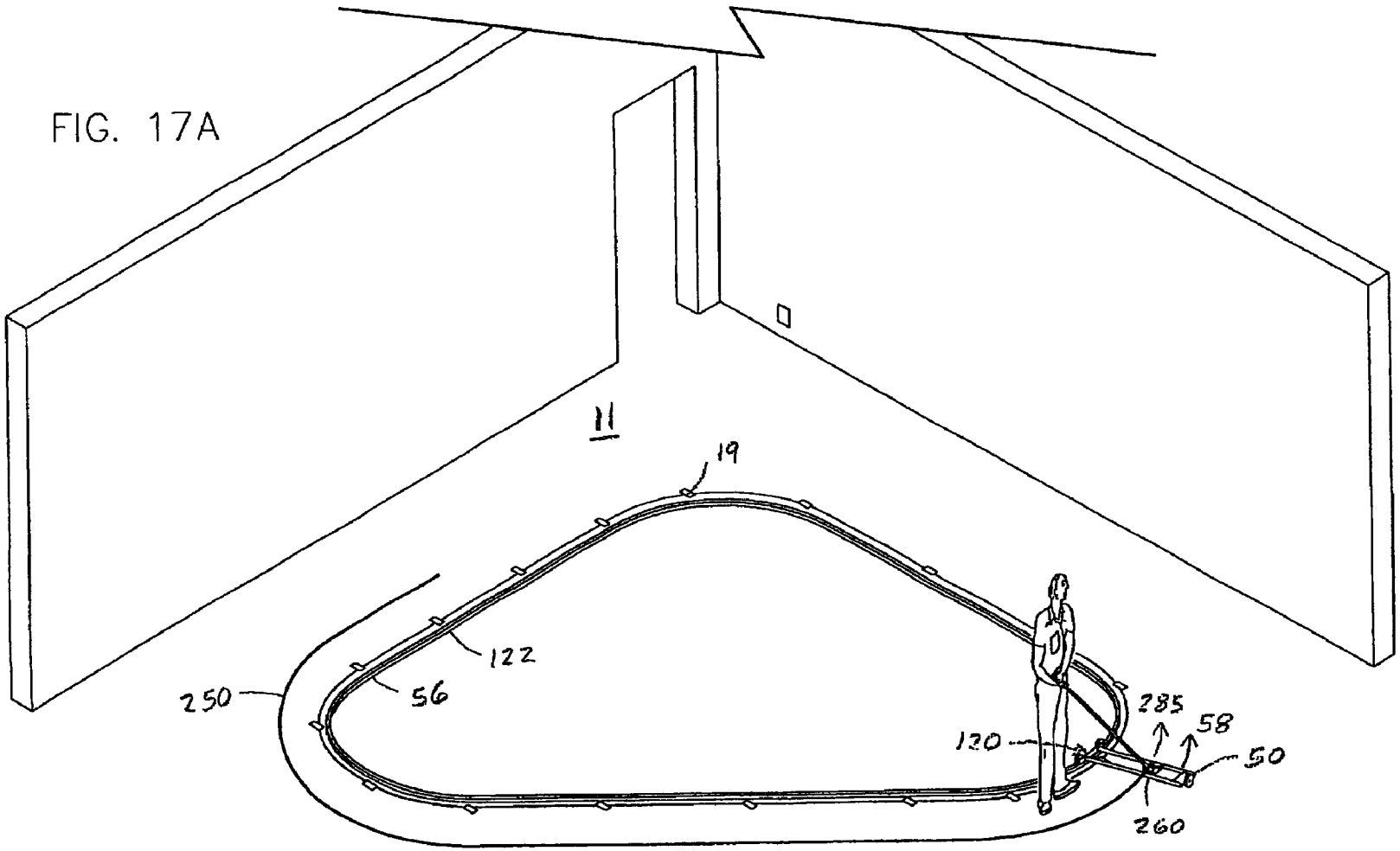
FIG. 17A is a perspective view of the apparatus with a track and wheel alignment mechanism secured to the floor and drawing a substantially triangular shaped border mark with linear and curved portions on the floor.

Although the process of using the apparatus 50 to mark the floor 10 and cut the floor coverings 20 and 30 should be apparent from the above disclosure, the following is provided to assist the reader in understanding the preferred method of using the apparatus to mark the floor with the border mark 250 and continuously cut a uniform seam 280 between the floor coverings. The desired pattern formed by at least two different floor coverings 20 and 30 is selected 300, and the reference point 55 or path 56 is determined 302. One end 52 of the apparatus 50 is secured 310 to the floor 10 at the reference point 55 or path 56 via the appropriate alignment mechanism 70, such as rotatable, telescoping, anchor assembly 81 shown in FIG. 14A or the track and wheel assembly 120 shown in FIG. 17A.

The apparatus 50 is set to mark the floor 10. The marking assembly 260 and marker 261 are positioned on and secured to 314 the working section 60 so that the tip 265 of the marker 261 is spaced a desired distance from the reference point 55 or path 56. The specific position is determined using the indicia on the forward and trailing members 62 and 63 of the frame 60, or a reference mark can be placed on these members to note this position. The marking assembly 260 is also adjusted 316 so that the marking tip 265 markingly engages the floor 10.

The apparatus 50 marks 320 the floor with at least one continuous border mark or line 250. The mark 250 is made by moving the apparatus 50 along its path of travel 58 defined by the reference point 55 or path 56. The alignment mechanism 70 remains secured to the reference point 55 or path 56 and the marker 261 remains in marking engagement with the floor 10. The apparatus 50 can be moved by hand or via the drive mechanism 210. The apparatus 50 is moved along the complete desired path of travel 58 to form the entire border mark 250 on the floor 10. The combination of the path of travel 58 of the apparatus 50 and the position of the marker 261 relative to the reference point 55 or 56 defines the path of travel 285 of the marker. As long as the apparatus 50 is secured at the reference point or path and the marker 261 remains at its set position on the frame 60, the marker will remain on this path of travel 285. The border mark 250 divides the room into different areas 12 and 14.

Figure 15A:
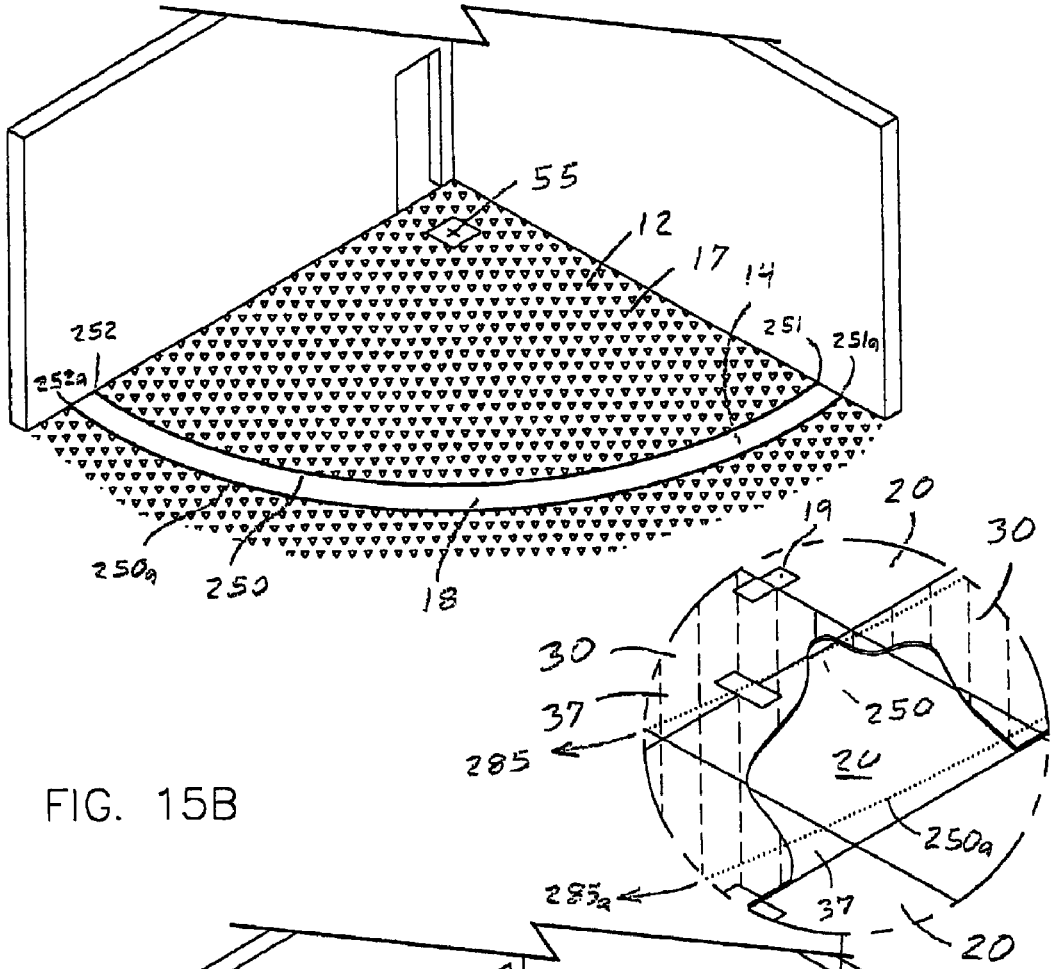
FIG. 15A is a perspective view of the floor marked with two concentric, evenly spaced border marks with the adhesive applied over the entire floor except in the area between the border marks.
Figure 16A:
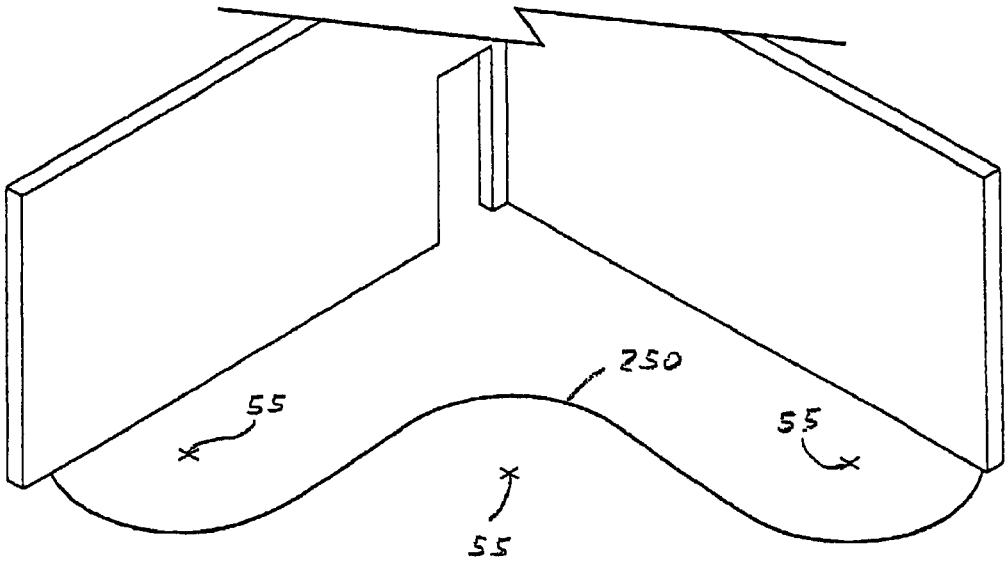
FIG. 16A is a perspective view of a floor marked with a wavy border mark formed by securing the apparatus to pivot points on alternating sides of the border mark.
Figure 16B:
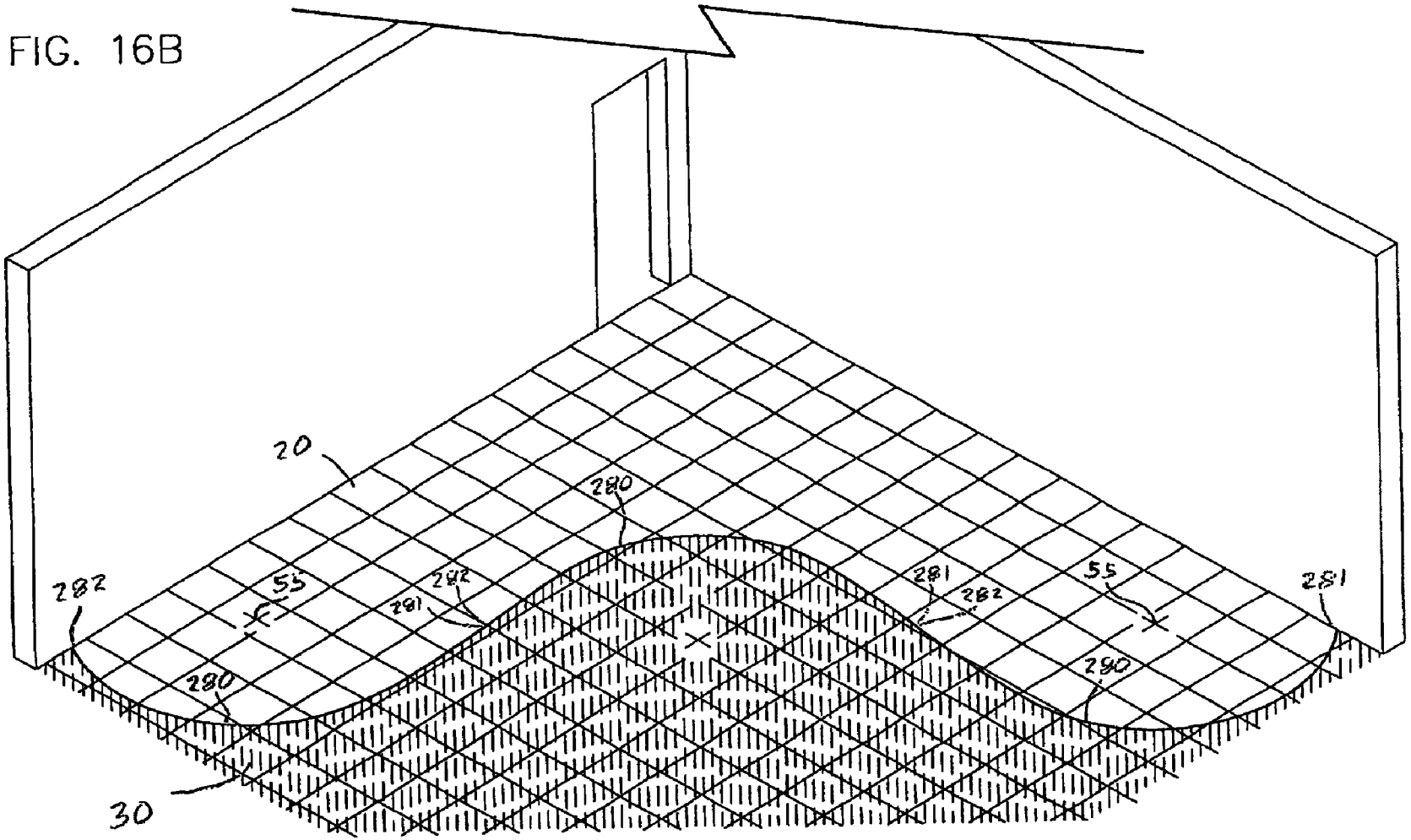
FIG. 16B is a perspective view of a completed floor pattern with the trimmed portions of the floor coverings removed and the cut edges of the floor coverings meeting to form a wavy uniform seam.
Figure 18:
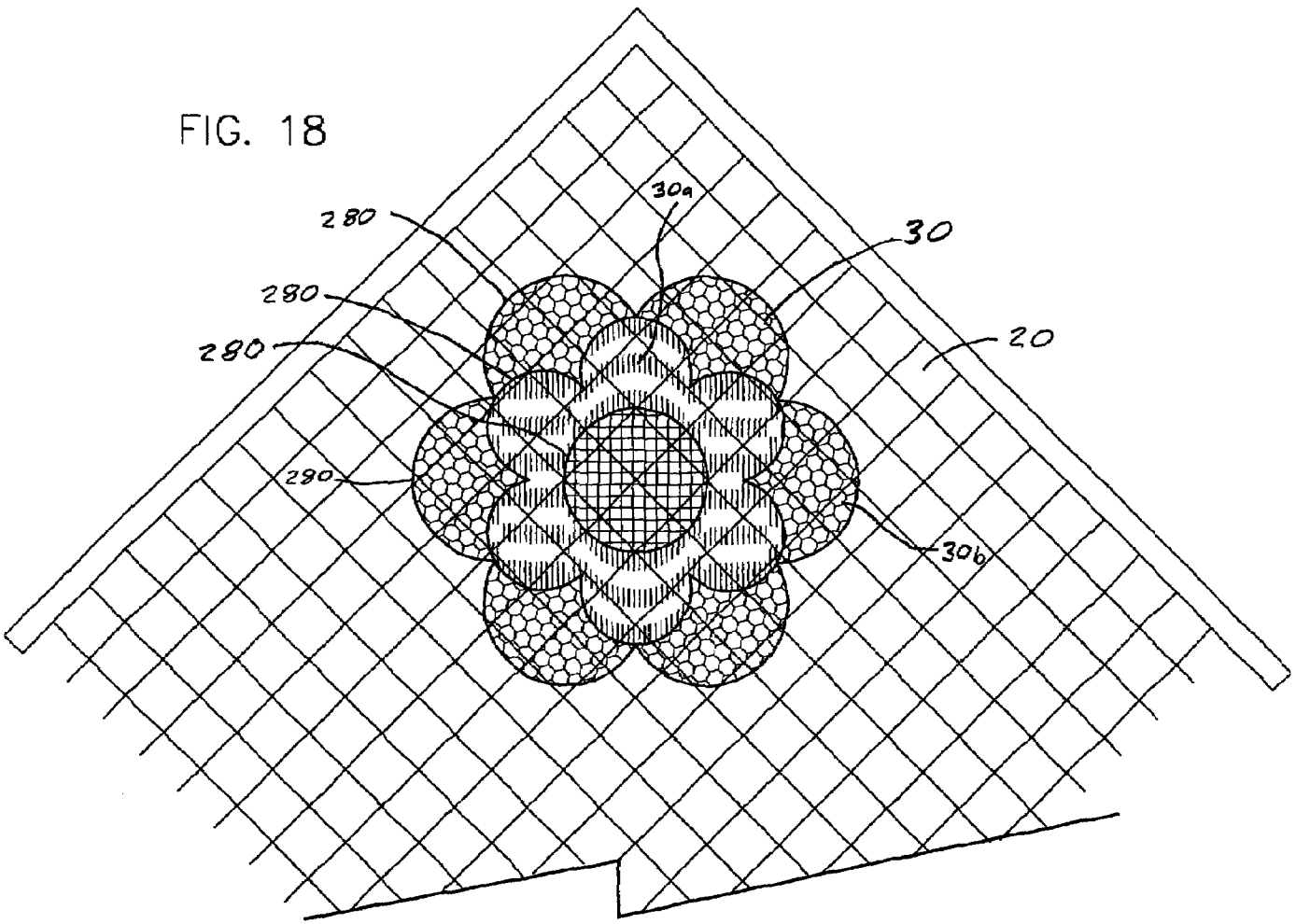
FIG. 18 is an overhead view of a completed flower shaped floor pattern with a center and multiple petals formed by several different floor coverings with the cut edges meeting to form several circular or semi-circular shaped seams.

Two or more concentric or parallel marks 250 such as to form a strip as in FIG. 15A can be marked on the floor 10 by positioning and securing 325 the marking assembly to a second or other alternate positions on the working section 60 so that the tip 265 of the marker 261 is a different distance from the reference point 55 or path 56. The apparatus 50 is again moved along its path of travel 58 to mark 327 the concentric or parallel mark on the floor 10. More elaborate border marks 250 such as a wavy border mark shown in FIG. 16A require the apparatus 50 to be secured to several reference points 55 and moved along several connecting paths of travel 58. Although the apparatus 50 can be used to form several separate marks on a floor 10 such as a flower petal design shown in FIG. 18, the method is shown and describe to form one or two continuous mark on the floor.

Figure 14A:
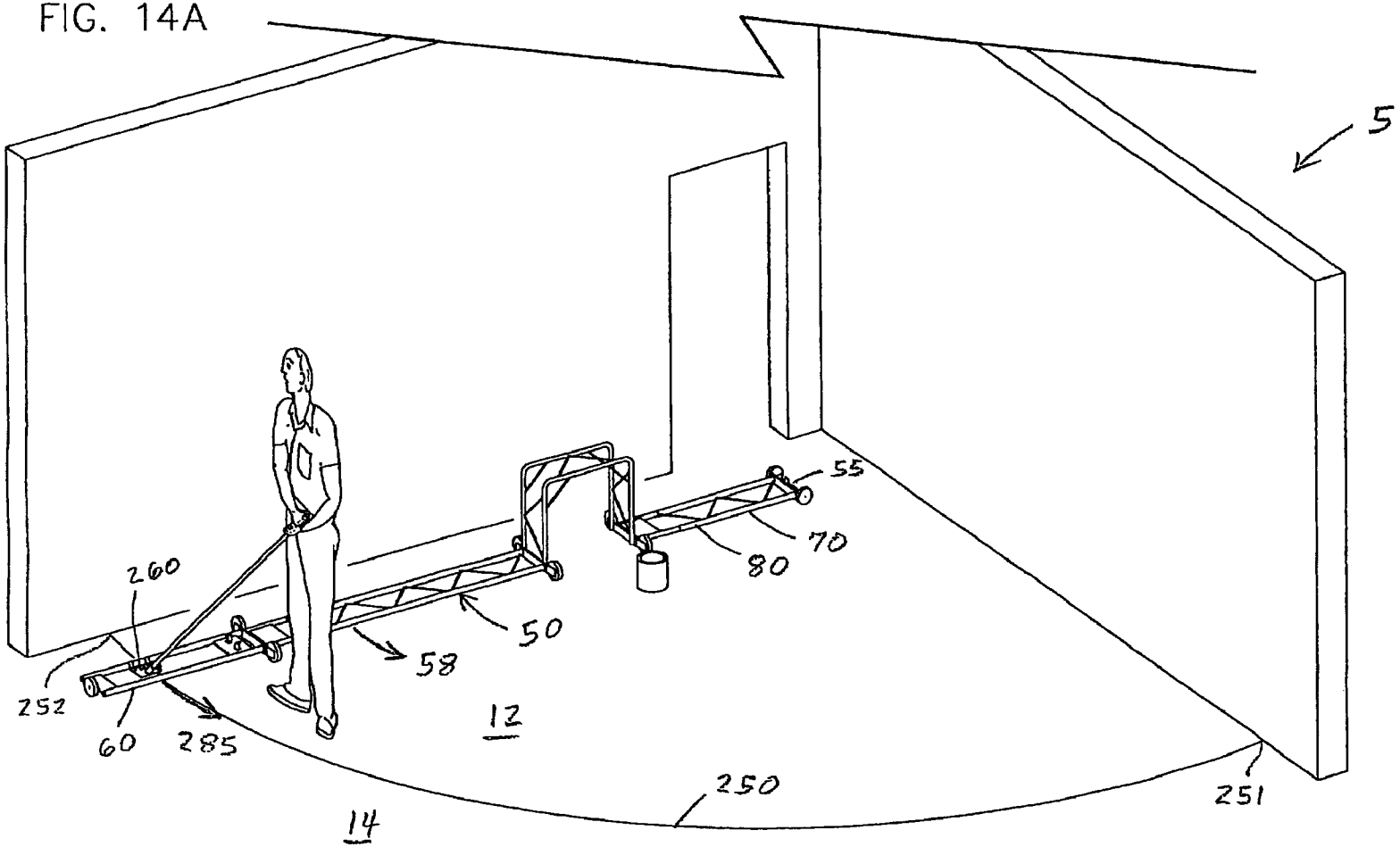
FIG. 14A is a perspective view of the inventive apparatus with the alignment mechanism secured to the floor at a pivot point to mark the floor with a single semi-circular border mark of constant radius to delineate two different areas of the floor.
Figure 14B:
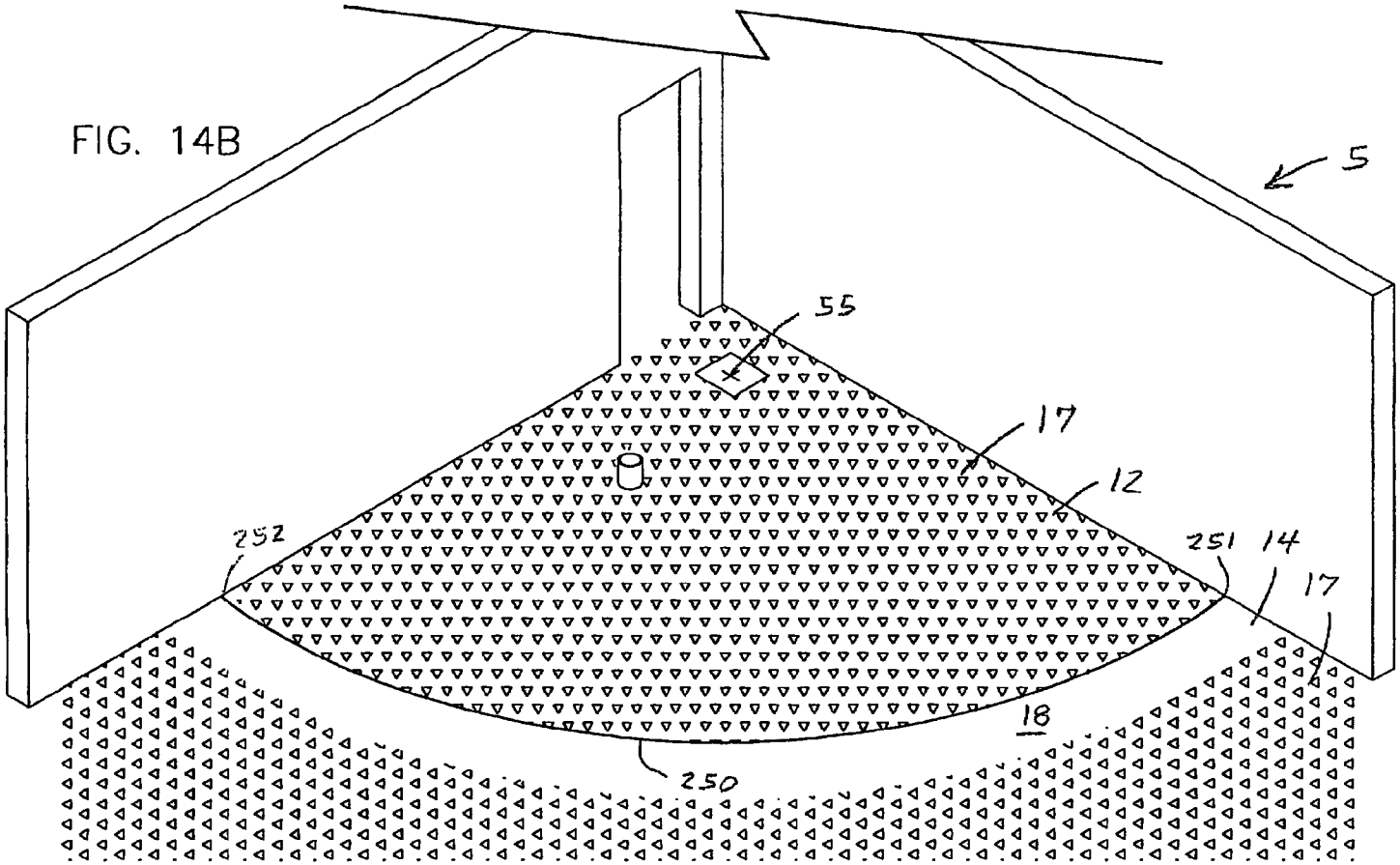
FIG. 14B is a perspective view of the marked floor with an adhesive applied across the surface of the floor except in an area along one side of the border mark and an area by a reference point.
Figure 14C:
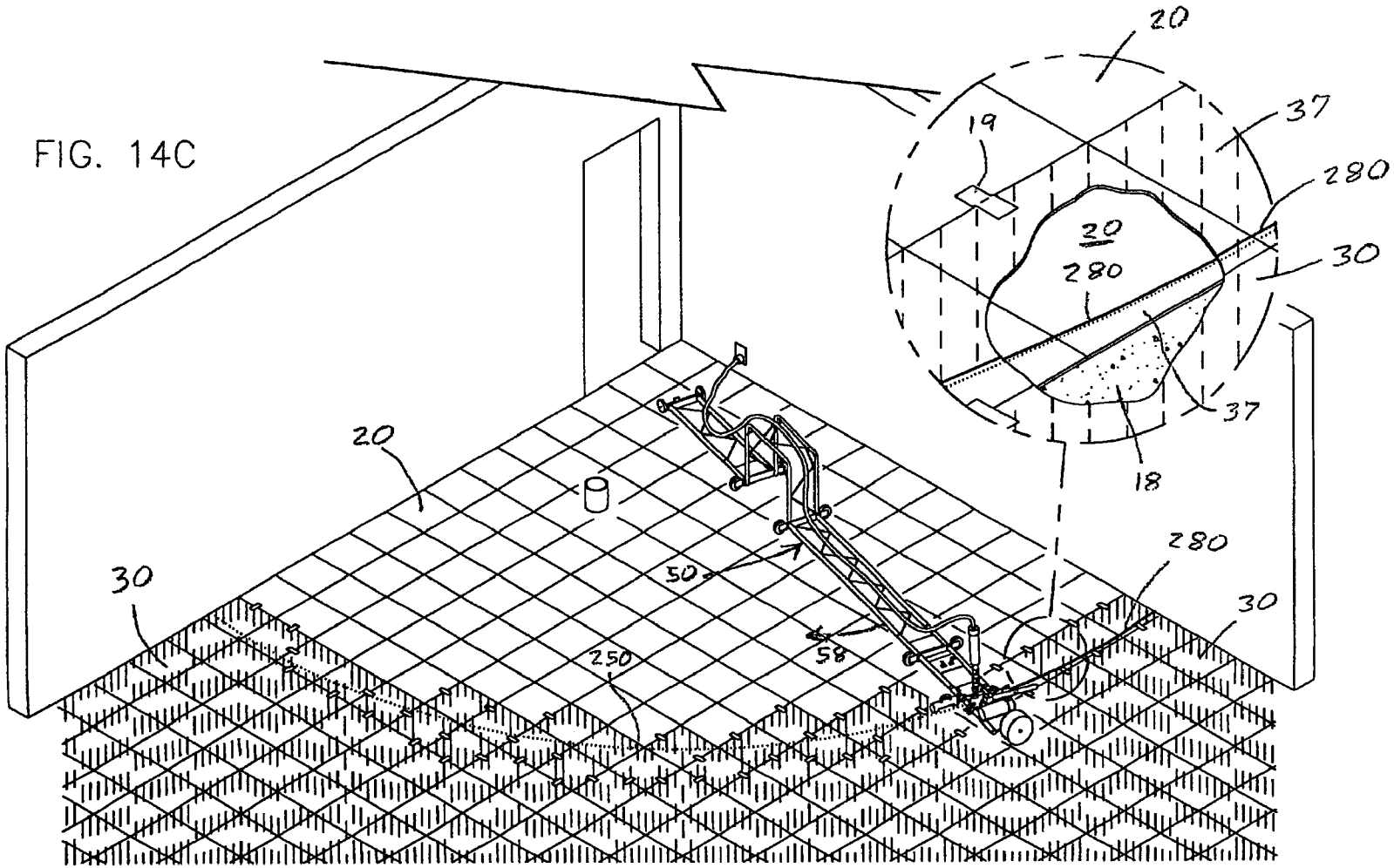
FIG. 14C is a perspective view of a first tile-type floor covering laid over the first area of the floor and a second tile-type of floor covering laid over the second area of the floor, with each floor covering continuously extending over the border mark shown in phantom, and the second floor covering overlapping the first floor covering along the border mark, the apparatus being secured at the pivot point and set to continuously heat and cut the floor coverings as its blade moves along a path of travel directly over the border mark to form a uniform cut or seam between the floor coverings.
Figure 14D:
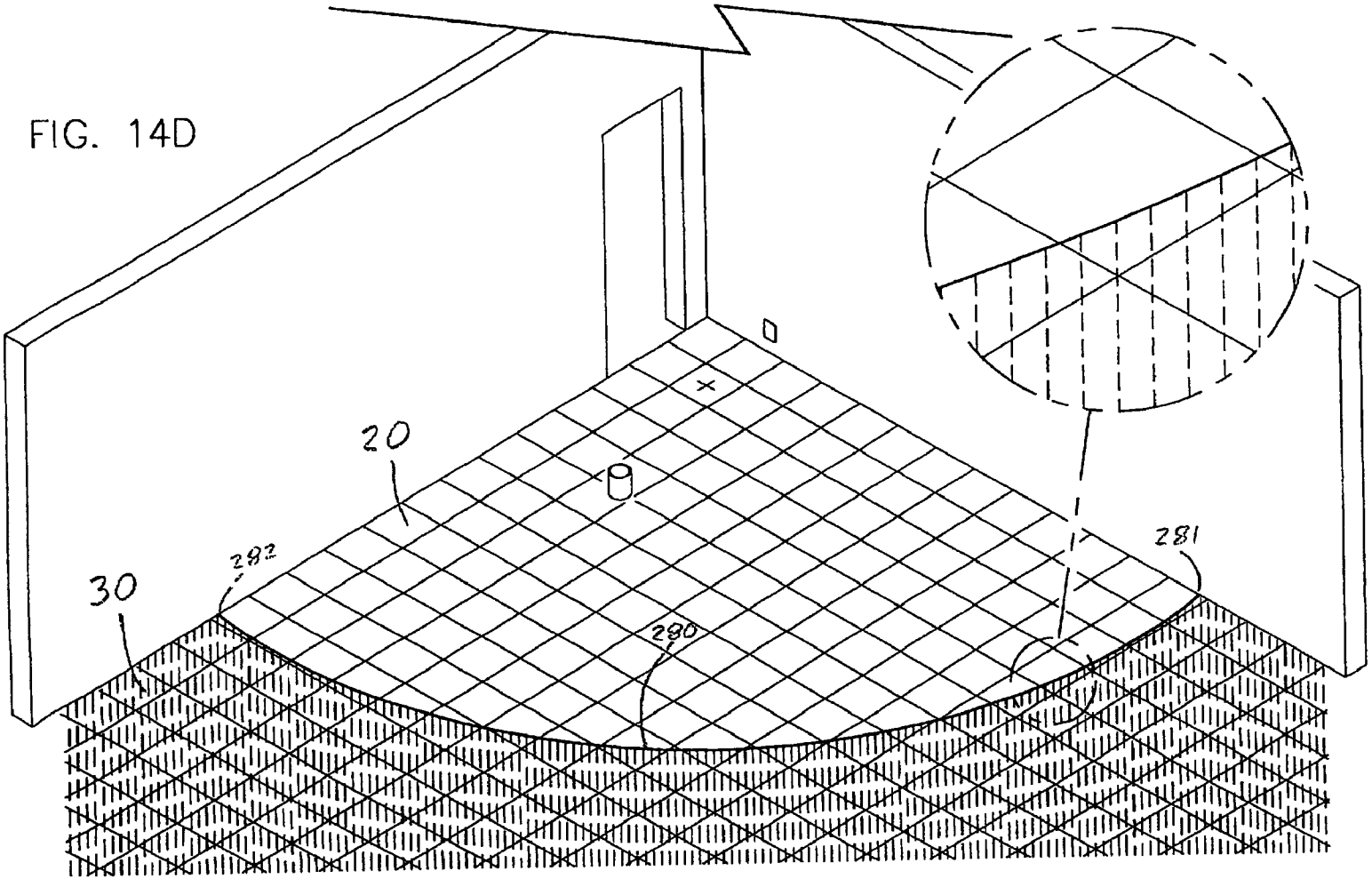
FIG. 14D is a perspective view of a completed floor pattern with the trimmed portions of the floor coverings removed and the cut edges of the floor coverings meeting to form a semi-circular shaped, uniform seam.
Figure 14E:
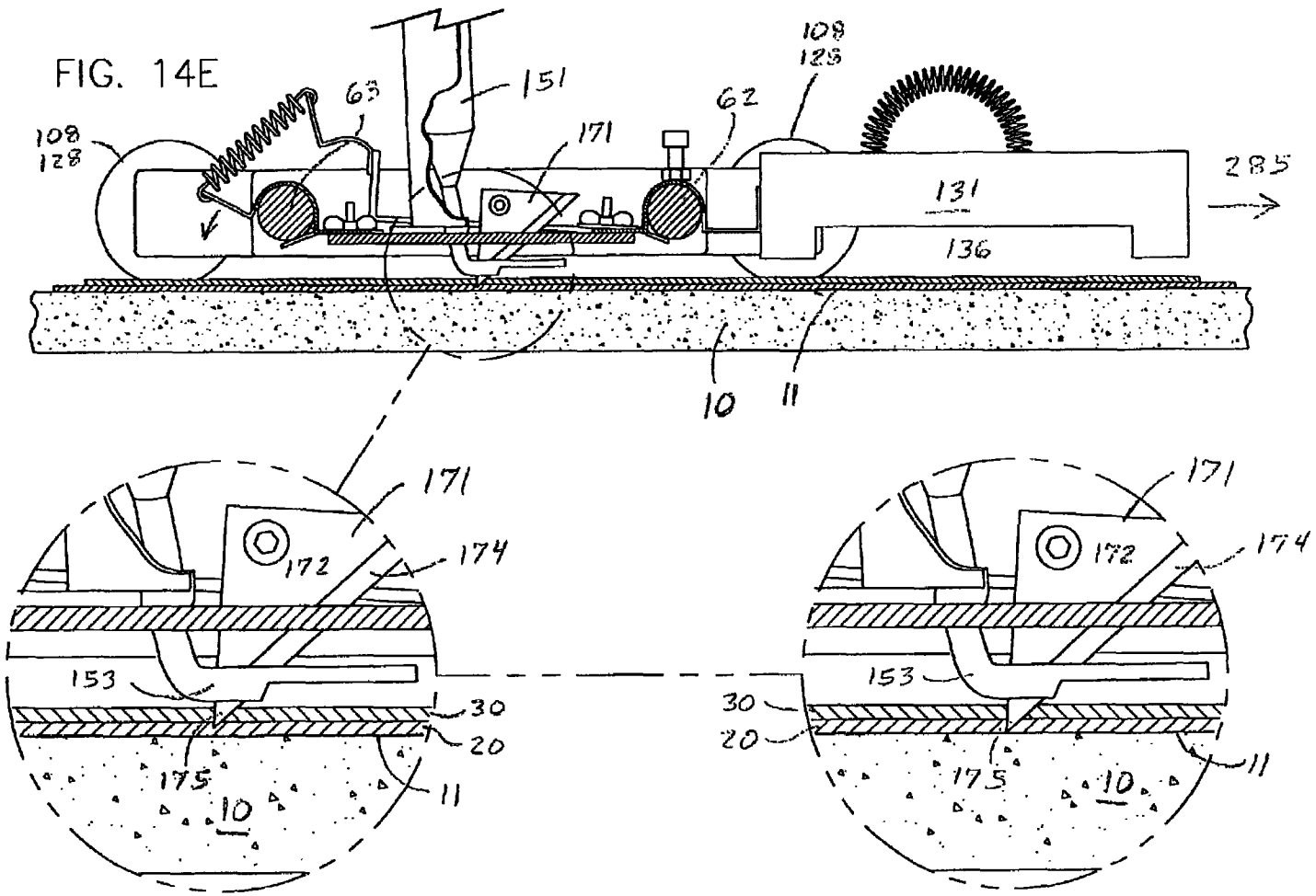
FIG. 14E is a side sectional view of the blade and heaters of the inventive apparatus as they move forward along the path of travel over the border mark to continuously heat and cut through both overlapping floor coverings, with two enlarged views showing the blade cutting to two different depths.
Figure 15B:
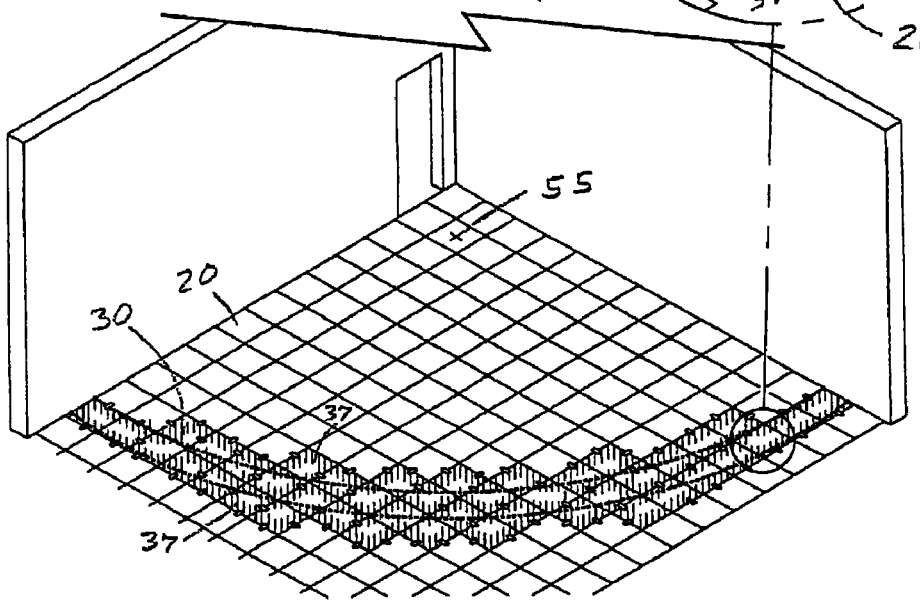
FIG. 15B is a perspective view of the first floor covering laid over the floor in the two areas outside the border marks shown in phantom and the second floor covering laid over the area between the border marks, with both floor coverings continuously extending over the border marks and the second floor covering overlapping the first floor covering over the border marks, and with the second floor covering secured by removable pieces of tape.
Figure 15C:
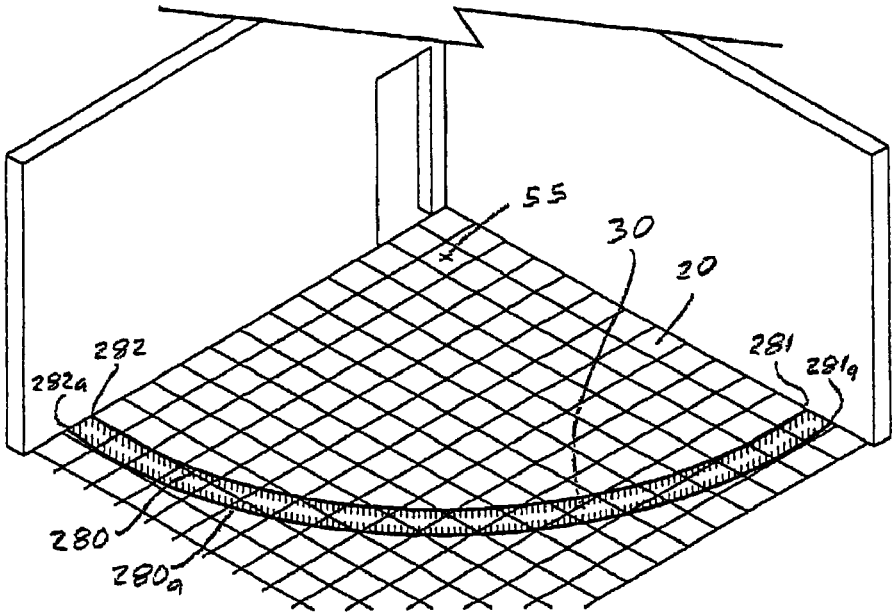
FIG. 15C is a perspective view of a completed striped floor pattern with the trimmed portions of the floor coverings removed and the cut edges of the floor coverings meeting to form two evenly spaced, semi-circular shaped, uniform seams.

A conventional glue or adhesive 17 is applied 330 to the floor 10 as in FIG. 14B. The adhesive 17 is applied over the area 12 where the first floor covering 20 will be placed right up to the border mark 250. The adhesive 17 can be applied to the entire area 12 or just a portion of that area as long as the glue is applied along the border mark 250. The adhesive 17 is preferably applied over the second area 14 where the second floor covering 30 will be placed except in a region 18 along the border mark 250. The adhesive 17 is also not applied to the area around at the reference point 55 or path 56 where the alignment mechanism 70 is secured to the floor 10. The apparatus 50 preferably remains secured to the floor 10 at the reference point 55 or path 56, but can be removed during the application of the glue 17. When the second area 14 is relatively narrow, such as a stripe as shown in FIG. 15A, little or no glue 17 is applied to the second area.

The floor coverings 20 and 30 are placed over their respective areas 12 and 14. One floor covering 20 is placed 332 over the first area 12 and is secured to the first area via the adhesive 17. The first covering 20 can cover the entire area 12 but must at least cover the area along the border mark 250. The first floor covering 20 lays flat on the floor 10 and continuously extends over the border mark 250 and into the second area 14 so that it completely covers the mark. The tiles 24 forming the first floor covering 20 should only be placed in the second area 14 to the extent needed to cover the border mark 250. As no tile 24 is completely in the second area 14, each tile 24 is at least partially secured to the floor via the glue 17 so that it will not move or shift when it is walked on or cut. When needed, a removable fastener such as a piece of tape 19 is used to firmly secure 334 the tile 24 to the glue free second area 14.

The second floor covering 30 is placed 336 over the other area 14. The second covering 30 can cover the entire area 14 but must at least cover the area along the border mark 250. The second floor covering 30 lays flat on the floor 10 in the second area 14 except where it is placed on top of or overlaps the first floor covering 20. The second floor covering 30 extends over the first area 12 so that it completely covers the border mark 250. Each overlapping tile 34 in the second floor covering 30 is aligned directly over one of the tiles 24 in the first floor covering 20. Each overlapping tile 34 is placed so that its edges flushly align with the edges of the tile 24 upon which it is placed. The first floor covering 20 lays flat on the floor 10 and continuously extends over the border mark 250. Each overlapping tile 34 is removably secured 338 in place via a removable fastener such as masking tape 19 or the like.

As the first floor coverings 20 completely cover the border mark 250, the apparatus 50 can be used to make a mark (not shown) on the upper surface of the first floor coverings before the second floor covering 30 is placed. The second mark is directly over the first border mark 250. This second mark helps ensure that the second floor covering 30 also completely covers the first border mark 250. The second mark is not needed if the tiles 34 forming the second floor covering 30 overlap the tiles 24 forming the first covering 30 two deep.

Figure 17B:
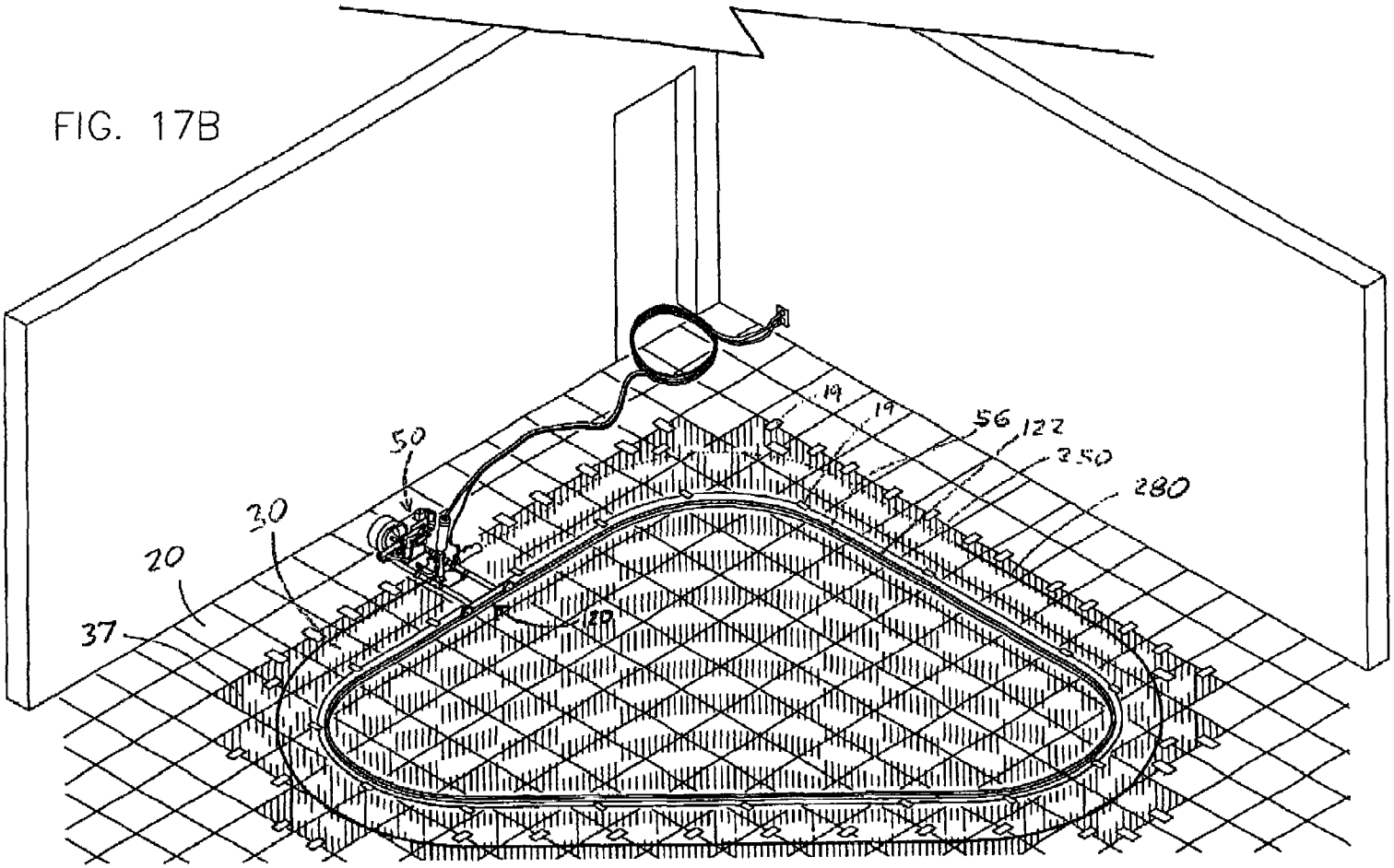
FIG. 17B is a perspective view of the first floor covering laid over the area of the floor outside the border mark shown in phantom and the second floor covering laid over a portion of the area inside the border mark, with both floor coverings continuously extending over the border mark and the second floor covering overlapping the first floor covering, and with the apparatus secured to move along the track and set to continuously heat and cut the floor coverings as its blade moves along a path of travel directly over the border mark to form a uniform cut or seam between the floor coverings.
Figure 17C:
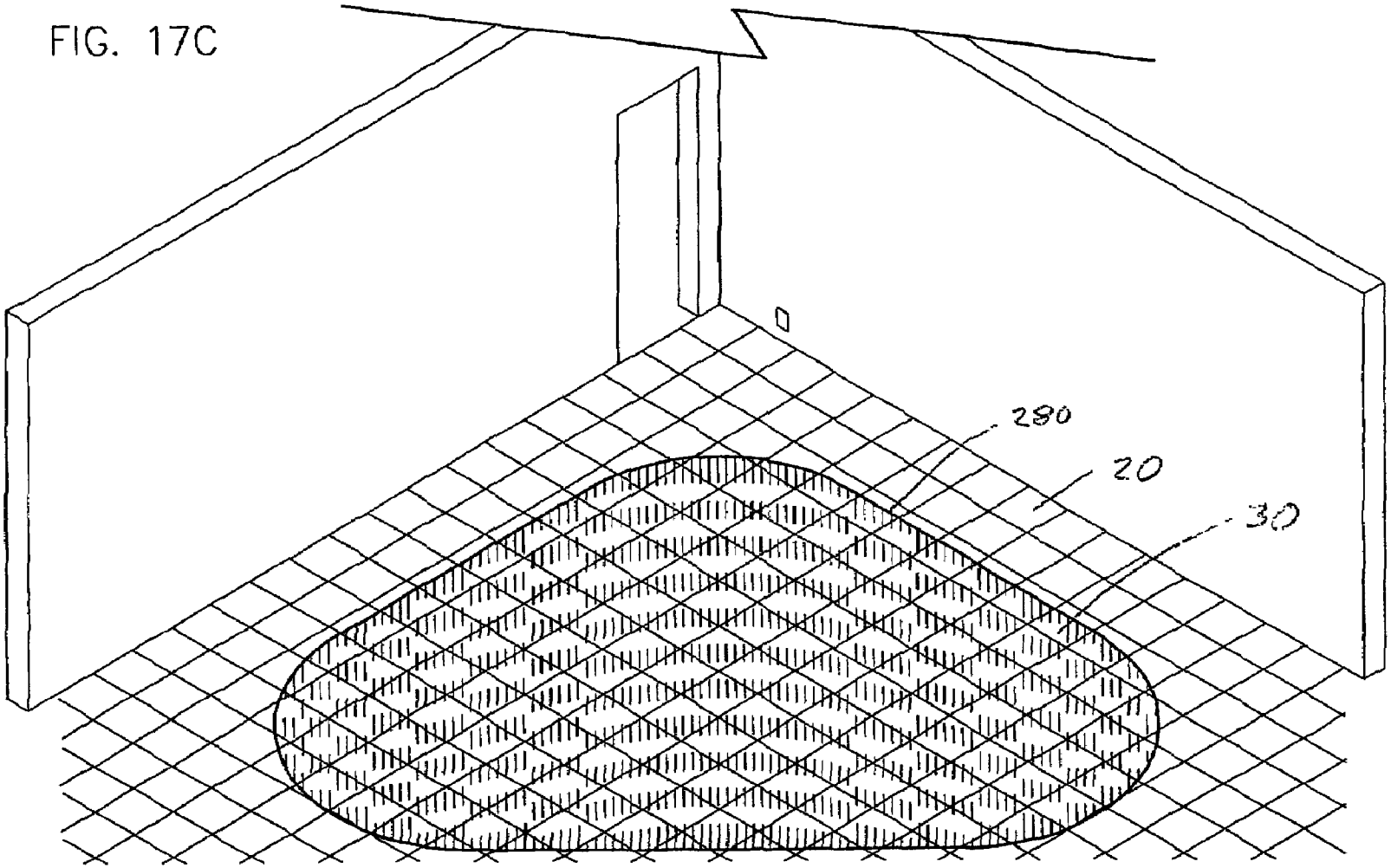
FIG. 17C is a perspective view of a completed floor pattern with the trimmed portions of the floor coverings removed and the cut edges of the floor coverings meeting to form a wavy uniform seam.

The process of marking and cutting the floor coverings 20 and 30 has been shown and described as marking the floor 10 with the border mark 250 before any amount of glue 17 is applied or portion of the floor coverings 20 and 30 are placed over the floor 10. Still, it should be understood that when the areas 12 and 14 are large and one or both of the floor coverings 20 or 30 is formed by several smaller pieces such as like-shaped tiles 24 or 34, the glue 17 and some of the tiles can be secured to the floor 10 in these areas away from the region where the border mark will be drawn prior to securing the apparatus 50 to the floor 10 and drawing the border mark 250. In addition, the process has been described to secure the apparatus 50 to the floor 10 and omitting the floor covering 20 or 30 around the reference point 55 or area 56 where the apparatus 50 is secured. Still, it should be understood that the broad aspect of the invention could secure the apparatus 50 on the tiles 24 or 34 during the step of cutting the floor coverings as shown in FIG. 17B.

The overlapping floor covers 20 and 30 are now ready to lap seamed together by the apparatus 50. The apparatus 50 is converted or otherwise set 340 to heat and cut the floor coverings 20 and 30. If necessary, the marking assembly 260 is removed and the heating assembly 130, cutting assembly 170 and drive mechanism 210 are secured to the frame 60. The blade 171 is positioned 342 on the frame 60 so that its cutting edge 174 and tip 175 are spaced the same perpendicular distance from the reference point 55 or path 56 as the tip 265 of the marker 261. The lengthwise indicia on the frame 60 or the previously formed reference mark, or a measuring tool such as a yard stick aligned perpendicular from the alignment bracket 87 are used to align the blade 171 at substantially the same position as the marker 261. As long as the alignment mechanism 70 is secured to the same reference point 55 or path 56, the blade 171 will move along the path of travel 285 directly over the border mark 250. This ensures that the blade 171 cuttingly engages both floor coverings 20 and 30 as it moves along its entire path of travel 285. The heating units 131 and 151 are also positioned or aligned 344 on the frame 60 so that they heat the blade 171 and an area directly in front of the blade as the apparatus 50. The heating devices 131 and 151 is generally positioned the same perpendicular distance from the reference point 55 or path 56 as the blade 171.

Before initiating the cut, the drive motor 211 and heating units 131 and 151 are turned on or otherwise activated. The handle 226 is in its disengaged position 240. The apparatus 50 is positioned so that the blade 171 is located over one end 251 or 252 of the mark 250. The heating and cutting assemblies 131 and 151 are moved to heatingly and cuttingly engage 346 the floor coverings 20 and 30, respectively. The heating units 131 and 151 heat the blade 171 and the portion of the floor coverings 20 and 30 in front of the blade to a desired temperature. For example, conventional vinyl tile floor coverings with a thickness of about ⅛ inch should be heated to about 90 to 140° F.

The drive mechanism 210 is engaged and the apparatus 50 moves in a continuous manner along its path of travel 58 from one end 251 of the mark 250 to the other 252 to continuously cut 350 a uniform seam 351 into the floor coverings 20 and 30 over the border mark 250. The motor 211 and drive wheel 220 continuously move the apparatus 50 forward at a constant rate of speed. The blade 171 is maintained in continuous cutting engagement with preferably both floor coverings 20 and 30 during the entire cut over the border mark 250. The apparatus 50 and blade 171 continuously move along their paths of travel 58 and 285 over the border mark 250 from one end 251 to the other 252 to thereby complete the uniform cut or seam through the overlapping floor coverings 20 and 30 lap seam the floor coverings together. The seam 280 is continuously and uniformly cut from one end 281 to the other 282. The apparatus 50 is then turned off or motor 211 is disengaged via handle 226 and the heating and cutting assemblies 130 and 170 are moved to their disengaged positions 169 and 199.

When the pattern includes two or more concentric seams 280, the cutting 171 and heating 131 and 151 devices are repositioned 352 on the working section 60 of the apparatus 50 while its end 52 remains secured to the reference point 55 or path 56 by its alignment mechanism 70. The cutting device 171 is positioned 352 so that it is aligned over the concentric mark 250*a*. The apparatus 50 is positioned at one end 251*a* or 252*a* of the concentric mark 250*a* and the blade 171 brought into cutting engagement with the floor coverings 20 and 30. The apparatus 50 is then moved along its path of travel 58 with the blade 171 continuously moving along its concentric or uniformly spaced path of travel 280*a* over the concentric mark 250*a* from end 251*a* to end 252*a* to thereby continuously cut 354 the overlapping floor coverings 20 and 30 to form a concentric uniform seam 280*a*. The seam 280*a* is continuously and uniformly cut from one end 281*a* to the other 282*a*.

The blade 171 and heating units 131 and 151 move at the same rate of speed or slightly slower or faster than the drive wheel, depending on whether the apparatus 50 is cutting a straight seam or one that is concave or convex. The blade 171 and heating units 131 and 151 move at a slightly slower rate of speed than the drive wheel 220 when the apparatus is cutting a concave seam and is secured to the floor 10 at reference point 55. The blade 171 and heating units 131 and 151 move at a slightly faster rate of speed than the drive wheel 220 when the apparatus is extending outwardly from the track, and is traveling on a convex section of the track to cut a convex seam 56.

The depth to which the blade 171 cuts the overlapping floor coverings 20 and 30 is a function of a variety of factors. These factors include the type and density of the floor covering being cut, the temperature or temperatures of the floor coverings 20 and 30 in the area being cut, the force with which the blade 171 is pressed down into the floor coverings, the shape and sharpness of the tip 175 of the blade, and the rate of speed the drive mechanism 210 moves the blade 171 along its path of travel 285. The type and density of the floor coverings and the shape and sharpness of the blade are typically fixed for a particular job. The depth of cut is thus controlled by the heating units 131 and 151, the force produced by the tension assembly 191 and the rate of speed of the drive motor 211. The more heat applied to the floor coverings 20 and 30, the more downward pressing force applied by the tension assembly 191, and the slower the rate of speed of the drive motor 211 and the blade 171 along its path of travel, the deeper the blade will cut into the floor coverings. During operation, the cutting apparatus 50 allows selective control of each of these factors. This allows the apparatus 50 to cut completely through both of the overlapping floor coverings 20 and 30 in a single pass. When these parameters are set to over-cut the floor coverings 20 and 30, the blade 171 presses into the surface of the floor 10, which is often concrete. The tip 175 of the blade dulls against the concrete floor 10 so that the blade only cuts to a depth just completely through both floor coverings. To save on wear and tear on the blade 171, the apparatus 50 can be adjusted so that the blade cuts completely through the upper layer 20 or 30 and almost completely through the lower layer 30 or 20.

Although the apparatus 50 is preferably set to cut completely through both overlapping floor coverings 20 and 30 in a single pass, it should be understood that because the blade 171 remains fixed over the border mark 250, the apparatus could be set to only cut completely through the upper floor covering during a first pass and set to cut completely through the lower floor covering during a second pass. The trimmed excess of the upper floor covering 30 could be removed before the second pass so that the heating units 131 and 151 are in direct heating contact with the lower floor covering during the second pass. Similarly, the apparatus 50 could be set to cut only partially through one of the layers of floor covering 20 or 30 during any single pass so that numerous passes are required to cut completely through both layers.

Once the complete uniform cut through both overlapping floor coverings 20 and 30 is made, the apparatus 50 is removed 370, and the excess trim of each floor covering that extends over the border mark 250 is removed 372. The cut edges of the floor coverings 20 and 30 are deburred 374. The upper floor covering 30 is pulled back or otherwise removed to gain access to the glue free area 18 along the border mark 250. Glue 17 is applied 376 to this area and the floor covering 30 is placed back over and secured to this area 378. The cut edge of both floor coverings 20 and 30 lay flat on the floor 10 in their respective areas 12 and 14 and are in flush alignment along the entire cut seam 351 over the border mark 250. The edges either smoothly abut each other or are spaced apart a slight amount to form a uniform gap along the entire length of the cut seam 351.

While the present invention is shown and described as being used to cut and lap seam two adjacent vinyl or linoleum tile floor coverings, it should be understood by one of ordinary skill in the art that floor coverings come in a wide variety of conventional materials such as plastic, ceramic, and the like, and that the invention is not limited to vinyl and linoleum tile floor coverings. Similarly, although the floor coverings 20 and 30 are shown and described as being formed by pieces of tile 25 or 35, it should be understood that one or both of the floor coverings could take the form of a single large sheet or several strips that are rolled out onto the floor 10 and cut to fit the room 5.

While the invention has been described with reference to several preferred embodiments, it will be understood by those skilled in the art that various changes may be made and equivalents may be substituted without departing from the broad aspects of the invention.

The invention claimed is:

1. A floor covering cutting apparatus for lap seaming two adjacent floor coverings made of a material such as vinyl or linoleum, the first floor covering being placed over a first surface area of the floor, and the second floor covering being placed over a second surface area of the floor, the first and second surface areas sharing a common border, the floor coverings being placed in overlapping arrangement along the common border, the floor covering cutting apparatus comprising:

a cutting assembly having a blade and a blade biasing mechanism, said blade being adapted to cuttingly engage the overlapping floor coverings along the common border, and said blade biasing mechanism being adapted to press said blade into cutting engagement with the overlapping floor coverings;

a heating assembly having a heating unit mounted in front of said blade and adapted to heat the floor coverings along the common border in front of said blade;

a drive mechanism including a motor adapted to continuously move said blade along a path of travel over the common border to form a uniform lap seam between the two floor coverings;

an alignment mechanism having opposed ends and adapted to guide said blade along a path of travel over said common border; and, a frame connecting said cutting assembly, heating assembly, drive mechanism and alignment mechanism together.

2. The floor covering cutting apparatus of claim 1, and wherein said alignment mechanism is movingly secured to the floor at a reference point.

3. The floor covering cutting apparatus of claim 2, and wherein said alignment mechanism includes a pivot pin adapted for pivotal securement to the floor, and a telescoping section.

4. The floor covering cutting apparatus of claim 1, and wherein said alignment mechanism is movingly secured to the floor along a reference path.

5. The floor covering cutting apparatus of claim 4, and wherein said alignment mechanisms includes a track and a wheel, said track being adapted for securement to the floor, and said wheel movingly engaging said track.

6. The floor covering cutting apparatus of claim 1, and wherein the common border and said path of travel of said blade are arcuate.

7. The floor covering cutting apparatus of claim 6, and wherein said heating assembly heats said floor coverings in an area directly in front of said blade to a temperature ranging between about 90° F. and 140° F.

8. The floor covering cutting apparatus of claim 7, and wherein the first floor covering is formed by a first set of like-shaped tiles, and the second floor covering is formed by a second set of like-shaped tiles, and said path of travel extends between multiple tiles of both said first and second sets of tiles, and said uniform lap seam is continuously cut along said path of travel.

9. The floor covering cutting apparatus of claim 8, and wherein said drive mechanism is adapted to drivingly engage the surface of the floor coverings, and said frame spaces said heating unit a substantially constant distance above said floor coverings as said apparatus moves along said path of travel.

10. The floor covering cutting apparatus of claim 9, and wherein each floor covering has an upper surface, and the upper surface of the first floor covering is different from the upper surface of the second floor covering, the first and second floor coverings combining to form a desired pattern.

* * * * *